US007524121B2

(12) United States Patent
Namekawa et al.

(10) Patent No.: US 7,524,121 B2
(45) **Date of Patent: *Apr. 28, 2009**

(54) IMAGE FORMING APPARATUS

(75) Inventors: Takumi Namekawa, Kanagawa (JP); Yoshio Kitamura, Kanagawa (JP); Hidaka Shinobu, Kanagawa (JP)

(73) Assignee: Sony Corporation, Tokyo (JP)

( * ) Notice: Subject to any disclaimer, the term of this patent is extended or adjusted under 35 U.S.C. 154(b) by 728 days.

This patent is subject to a terminal disclaimer.

(21) Appl. No.: 11/105,941

(22) Filed: Apr. 13, 2005

(65) Prior Publication Data

US 2005/0175388 A1 Aug. 11, 2005

Related U.S. Application Data

(63) Continuation of application No. 10/280,531, filed on Oct. 25, 2002, now Pat. No. 6,923,584.

(30) Foreign Application Priority Data

Mar. 22, 2001 (JP) ..... P2001-083580
Oct. 26, 2001 (JP) ..... 2001-329779

(51) Int. Cl.
*B41J 13/10* (2006.01)

(52) U.S. Cl. ..... 400/625; 400/602; 400/693; 347/108; 271/218

(58) Field of Classification Search ..... None
See application file for complete search history.

(56) References Cited

U.S. PATENT DOCUMENTS 1,764,620 A 6/1930 Goetz
4,847,632 A 7/1989 Norris
5,746,528 A 5/1998 Mayer et al.
6,000,870 A 12/1999 Koga
6,106,178 A 8/2000 Chiu
6,132,122 A 10/2000 Robinson et al.
6,296,407 B1 10/2001 McKay et al.
6,923,584 B2 * 8/2005 Namekawa et al. ..... 400/625
2005/0179757 A1 * 8/2005 Namekawa et al. ..... 347/86

FOREIGN PATENT DOCUMENTS

JP 01292359 11/1989
JP 10-338383 12/1998

* cited by examiner

*Primary Examiner*—Jill E. Culler
(74) *Attorney, Agent, or Firm*—Robert J. Depke; Rockey, Depke & Lyons, LLC.

(57) ABSTRACT

A printer includes a front panel having an approximately flat main surface which serves as one of the surfaces of the external housing of the printer, a feed-tray attachment hole for detachably attaching a feed tray which stores a paper sheet to the main body of the printer, and an output hole for outputting the paper sheet after an image is printed, and an output door which is attached to the external panel to cover the output hole such that the output door can be opened and closed, the output door being opened when the printed sheet is output through the output hole. The output door serves as an auxiliary output tray while the output door is open and the printed paper which is output through the output hole is placed on the top surface of the output door.

14 Claims, 28 Drawing Sheets

IMAGE FORMING APPARATUS

The subject matter of application Ser. No. 10/280,531 is incorporated herein by reference. The present application is a continuation of U.S. application Ser. No. 10/280,531 filed Oct. 25, 2002, now U.S. Pat. No. 6,923,584 which claims priority to Japanese Patent Application NoJP2001-329779, filed Oct. 26, 2001. The present application claims priority to these previously filed applications.

BACKGROUND OF THE INVENTION

1. Field of the Invention

The present invention relates to an image forming apparatus, for example, an inkjet printer, for forming an image on a recording medium.

2. Description of the Related Art

Recently, terminal devices such as personal computers have become popular, and printers for printing image information including character information made by such terminal devices as documents have come into widespread use. In image forming apparatuses such as printers, feed trays for storing paper sheets are usually attached in a detachable manner. In addition, in image forming apparatuses which perform a print operation by the inkjet method, ink tanks are also attached in a detachable manner so that they can be exchanged. In the image forming apparatuses, the print operation is performed while the feed tray which stores the paper sheets is attached to the main body. In the print operation, the paper sheet is supplied from the feed tray, an image is printed on the paper sheet, and the printed paper sheet is output through an output hole formed in the main body. The user must supply the feed tray with paper sheets and exchange the ink tanks as necessary.

In the known image forming apparatuses, the feed tray is attached to, for example, the exterior of the main body. However, in such image forming apparatuses, the quality of paper sheets is easily degraded while they are being stored. Even when the feed tray is disposed in the main body of the image forming apparatus, there is a risk in that dust will enter the main body since the output hole, which is continuous to a printing section including a print head, etc., is not covered. As a result, dust collects on, for example, nozzles of the print head in the main body, and the risk that the print failure will occur and the number of times the nozzle maintenance is required are increased. Thus, sufficient reliability cannot be obtained.

On the other hand, recently, networks in which audio/visual (AV) equipment and personal computers are connected to each other have been under development. In view of such a situation, the image forming apparatuses, such as printers, which serve as peripheral equipment of the personal computers, are preferably used while they are stored on a rack, etc., together with other AV devices. Generally, AV devices have a stackable structure so that they can be easily stored on a rack, etc., in an orderly fashion, as represented by an arrangement of a television set and a video deck.

However, unlike other AV devices, the image forming apparatuses do not have a stackable structure such that an object can be put on the top. Therefore, the image forming apparatuses require a large storage space. As described above, in the image forming apparatuses, paper sheets must be supplied and the ink tanks must be exchanged as necessary. However, if the image forming apparatus is stored on a rack, it must be taken out from the rack in order to perform such maintenance, which requires complex work from the user.

SUMMARY OF THE INVENTION

Accordingly, in view of the above-described situation, an object of the present invention is to provide a high-reliability image forming apparatus which can be easily operated and which provides great convenience to the user.

In order to attain such an object, according to the present invention, an image forming apparatus which forms an image on a paper sheet includes an external panel having an approximately flat main surface which serves as one of the surfaces of the external housing of the image forming apparatus, a feed-tray attachment hole for detachably attaching a feed tray which stores the paper sheet to the main body of the image forming apparatus, and an output hole for outputting the paper sheet after the image is printed; and an output door which is attached to the external panel to cover the output hole such that the output door can be opened and closed, the output door being opened when the printed paper sheet is output through the output hole. The output door serves as an auxiliary output tray while the output door is open and the printed paper sheet which is output through the output hole is placed on the top surface of the open output door.

In the image forming apparatus of the present invention, an operation of attaching/detaching the feed tray to the main body and an operation of taking out the paper sheet from the output hole which faces outward through the open output door can be performed through the external panel which forms one of the surfaces of the external housing. Accordingly, since the main operations of the image forming apparatus can be performed through the external panel, high operability is ensured. In addition, since the main operations can be performed through the external panel, the top surface of the external housing can be utilized freely, so that the image forming apparatus of the present invention can be stacked together with other devices. Accordingly, installation space can be reduced. In addition, it is not necessary for the user to perform complex work, so that great convenience is provided. Furthermore, in the image forming apparatus of the present invention, the possibility that dust will enter the main body can be greatly reduced and paper sheets can be stored without degrading them, so that high reliability is ensured.

BRIEF DESCRIPTION OF THE DRAWINGS

FIG. 21A shows the manner in which a rotating lever is rotated leftward and FIG. 21B shows the manner in which the rotating lever is rotated rightward;

FIG. 22A shows the manner in which a contacting tab is moved toward the rotating lever in the equilibrium state from the right, FIG. 22B shows the manner in which the rotating lever is rotated from the state shown in FIG. 22A by being pushed by the contacting tab, FIG. 22C shows the manner in which the contacting tab is moved toward the rotating lever in the equilibrium state from the left, and FIG. 22D shows the manner in which the rotating lever is rotated from the state shown in FIG. 22C by being pushed by the contacting tab;

DESCRIPTION OF THE PREFERRED EMBODIMENT

An embodiment of the present invention will be described in detail below with reference to the accompanying drawings.

Figure 1:
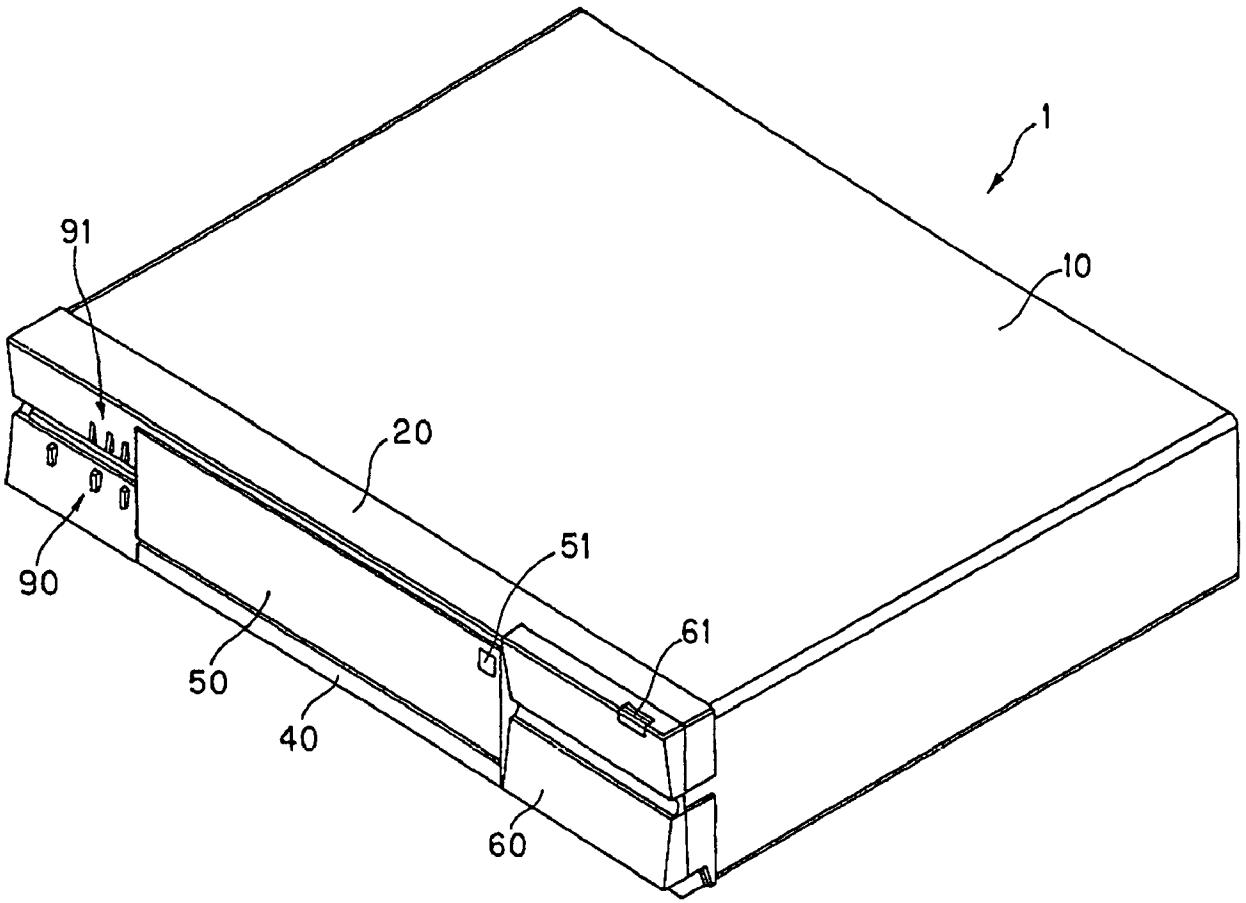
FIG. 1 is an external perspective view of a printer according to a first embodiment of the present invention.

According to the embodiment of the present invention, the present is applied to a printer which prints on a paper sheet, which serves as a recording medium, by the inkjet method and which includes a serial head whose length is shorter than the width of the paper sheet. FIG. 1 shows the external view of the printer. With reference to FIG. 1, the printer 1 has an approximately rectangular parallelepiped shape, and a front panel 20 which serves as an operation surface through which the user attaches/detaches a feed tray, takes out the paper sheet from an output hole, exchanges ink tanks, etc., is disposed such that it faces the user. The top surface of the printer 1 is approximately flat, so that an object can be put thereon. In the following descriptions, unless specifically described, the surface of the printer 1 which faces the user is called a front surface, and surfaces at the right and left sides when the front panel 20 is viewed from the front are called a right surface and a left surface, respectively.

Figure 2:
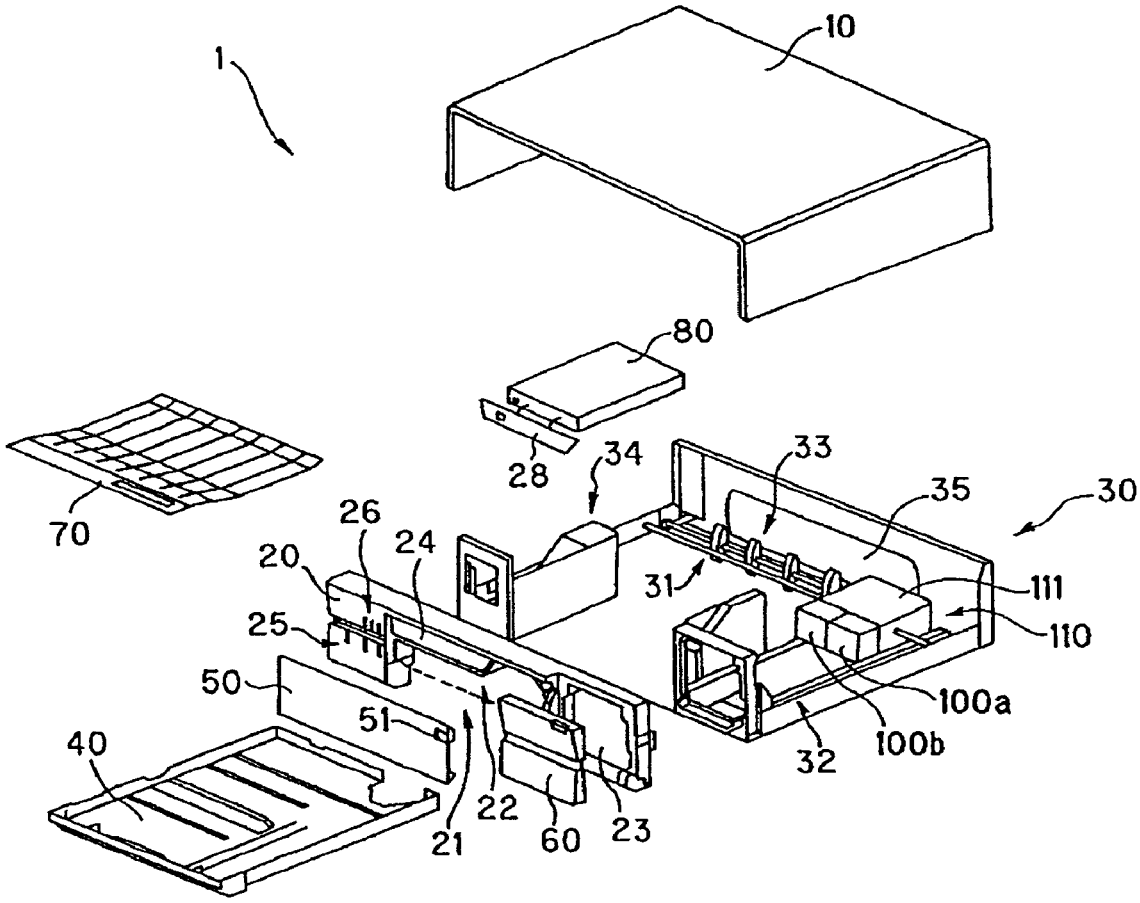
FIG. 2 is an exploded perspective view showing the construction of the printer.

FIG. 2 is a schematic exploded view of the printer 1. The printer 1 includes at least a cover 10 which forms the top surface and the right and left surfaces of the printer 1 when the surface facing the user is the front surface; a front panel 20 which serves as an external panel and which forms the front surface of the printer 1; a main body 30 which forms the bottom surface and the rear surface of the printer 1; a feed tray 40 which stores paper sheets to be fed; an output door 50 which covers an output hole 22, which will be described below; an ink-exchange door 60 through which ink tanks 100*a* and 100*b*, which will be described below, are exchanged; and an output tray 70 for outputting a printed paper sheet. In addition, the printer 1 may also include, as necessary, an optional device 80 for expanding the functions, which will be described below.

The cover 10 forms the top surface and the right and left surfaces of the printer 1 having the approximately rectangular parallelepiped shape, and at least the top surface is approximately flat. The cover 10 is attached to the main body 30 after being positioned with respect to the main body 30, and forms a part of an external housing of the printer 1.

Figure 3:
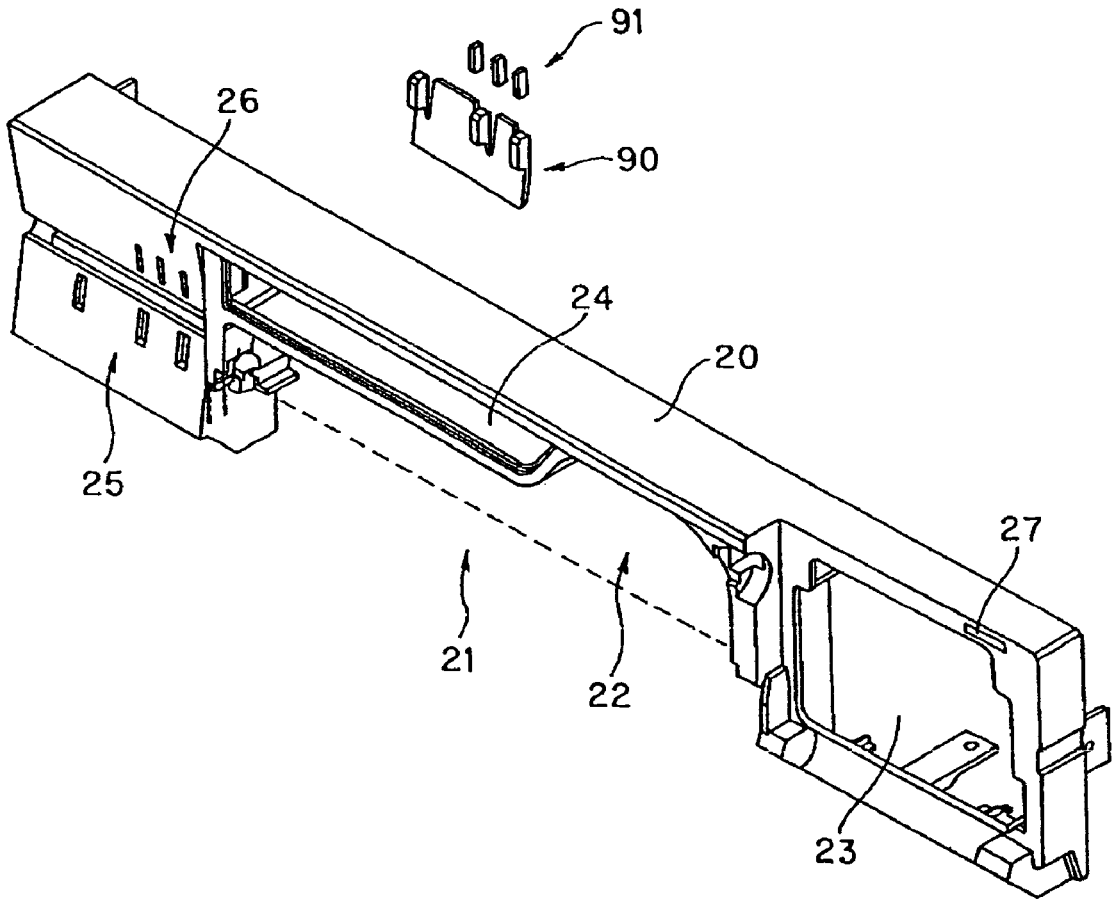
FIG. 3 is an exploded perspective view showing the construction of a front panel included in the printer.

The front panel 20 forms the front surface of the printer 1 having the approximately rectangular parallelepiped shape, and has an approximately flat main surface. As shown in FIG. 3, the front panel 20 has at least a feed-tray attachment hole 21 for detachably attaching the feed tray 40 to the main body 30; the output hole 22 for outputting the printed paper sheet; an ink-exchange hole 23 for exchanging the ink tanks 100*a* and 100*b*; an optional-device attachment hole 24 for detachably attaching the optional device 80 to the main body 30; a switch hole group 25 for exposing a switch group 90 including one or more operation members for various operations to the outside; and a lamp-hole group 26 for exposing a lamp group 91 including one or more light-emitting devices for indicating various states of the printer 1 to the outside.

The switch group 90 includes, for example, a power switch of the printer 1, a switch for other operations such as an operation of switching operation modes, etc. In addition, the lamp group 91 includes, for example, a lamp which indicates that the power is ON, a lamp which indicates that the print operation is being performed, a warning lamp which indicates that the paper sheet is jammed in the main body 30 or one or both of the ink tanks 100*a* and 100*b* must be exchanged, etc. For example, in the printer 1, when a sensor disposed in the main body 30 detects that paper jam has occurred, the lamp which indicates that the paper sheet is jammed in the main body 30 turns on. In order to indicate whether the paper jam has occurred during a paper feed operation or during a paper output operation, the light emission pattern or the color of light is changed in accordance with the situation. Alternatively, a plurality of lamps corresponding to each situation may be provided. In addition, in the printer 1, the amounts of ink discharged from the ink tanks 100*a* and 100*b* are determined electrically. When the determined amount of ink discharged from one of the ink tanks 100*a* and 100*b* exceeds a predetermined volume, the lamp which indicates that this ink tank must be exchanged turns on. In order indicate which one of the ink tanks 100*a* and 100*b*, which are used for, for example, color printing and monochrome printing, respectively, must be exchanged, the light emission pattern or the color of light is changed in accordance with the situation. Alternatively, a plurality of lamps corresponding to each of the ink tanks 100*a* and 100*b* may be provided. The lamp group 91 of the printer 1 may also include, as necessary, a lamp for prompting the user to close the output door 50 when it is maintained open. In such a case, a sensor for detecting whether there are any paper sheets placed on the top surface of the open output door 50 may be provided, and the lamp may be turned on when the output door 50 is open and no paper sheet is place thereon.

The front panel 20 is attached to the main body 30 after being positioned with respect to the main body 30, and forms a part of the external housing of the printer 1. As described below, the output door 50 for covering the output hole 22 and the ink-exchange door 60 for covering the ink-exchange hole 23 are attached to the front panel 20.

The main body 30 forms the bottom surface and the rear surface of the printer 1 having the approximately rectangular parallelepiped shape. Thus, at least the cover 10, the front panel 20, and the main body 30 form the external housing of the printer 1 having the approximately rectangular parallelepiped shape. The specifications of the cover 10, the front panel 20, and the main body 30 are of course determined such that the printer 1 operates without any problems even when an object having a predetermined weight is placed on the top surface of the cover 10. As described in detail below, the main body 30 contains various driving mechanisms including a head-unit driving mechanism 31 which moves a head unit 110 constructed by attaching the ink tanks 100*a* and 100*b* to an ink-tank carriage 111 during the print operation; an ink-tank driving mechanism 32 which moves the ink tanks 100*a* and 100*b* when they are exchanged; and a paper-reversing mechanism 33 which reverses the paper sheet supplied from the feed tray 40 and conveys the paper sheet to a printing unit included in the head unit 110. Although not shown in the figure, the main body 30 additionally contains an output-door opening mechanism for opening the output door 50 in a state such that the output door 50 is closed to cover the output hole 22 and a lock mechanism which locks the ink-exchange door 60 so that the ink-exchange door 60 cannot be opened manually by the user while the ink-exchange door 60 is closed to cover the ink-exchange hole 23, described below. In addition, the main body 30 also contains an electric control unit 34 which supplies electricity to the switch group 90 and the lamp group 91 and controls them and other various electric systems which are not shown in the figure. Furthermore, although not shown in the figure, the main body 30 may also contain an automatic paper output mechanism for automatically outputting the paper sheet when it is jammed in the main body 30, as described below.

As shown in FIG. 2, the main body 30 is constructed such that at least a space for attaching the feed tray 40 and a space for outputting the paper sheet are provided in an area between the front surface at which-the front panel 20 is disposed and the printing section. More specifically, in the main body 30, the ink-tank driving mechanism 32 is disposed at the right side along the right surface, the electric control unit 34 is disposed at the left side along the left surface, and the head-unit driving mechanism 31 and the paper-reversing mechanism 33 are disposed at the rear along the rear surface, so that the space for feeding and outputting the paper sheet is provided at the central area. In the printer 1, the space where the feed tray 40 is attached is continuous to the feed-tray attachment hole 21 in the front panel 20, and the space where the paper sheet is output is continuous to the output hole 22 in the front panel 20.

In the printer 1, when the paper sheet is jammed in the main body 30, the user inserts his or her hand into the space where the paper sheet is output. More specifically, when paper jam occurs in the main body 30 during the paper output operation, the user takes out the jammed paper sheet by inserting his or her hand through the output hole 22 in the front panel 20. In addition, as described below, a paper-removing hole 35 is formed in the rear surface of the main body 30, and when paper jam occurs in the main body 30 during the paper feed operation, the user takes out the jammed paper sheet through the paper-removing hole 35. Furthermore, as described below, the main body 30 has a lamp for maintenance, which is a light-emitting device which emits light when paper jam occurs in the main body 30. More specifically, this lamp illuminates the inside of the main body 30 when paper jam occurs, so that the user can easily view the inside of the main body 30 when the user inserts his or her hand to remove the jammed paper sheet. As a substitute for this lamp, light emitted from, for example, a sensor (not shown) which is disposed in the main body 30 for detecting the kind, in particular, the width, of the paper sheet to be printed may also be utilized.

Figure 4:
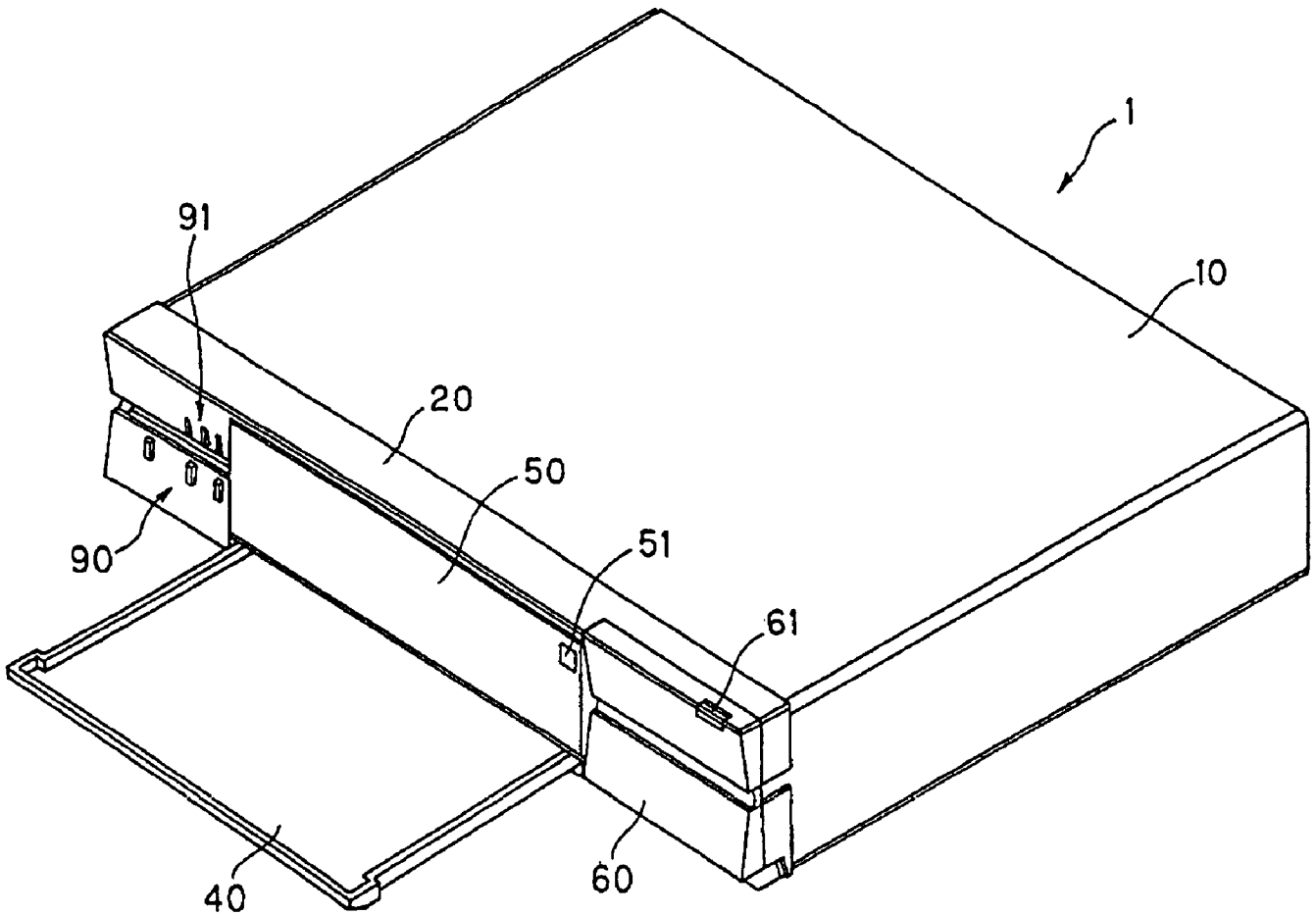
FIG. 4 is an external perspective view of the printer showing the manner in which a feed tray of the printer is attached/detached to/from the main body of the printer.

The feed tray 40 is inserted through the feed-tray attachment hole 21 in the front panel 20 and is attached to the main body 30 in a manner shown in FIG. 1. In addition, as shown in FIG. 4, the feed tray 40 can be detached from the main body 30 by pulling it out though the feed-tray attachment hole 21. As shown in FIG. 4, the feed tray 40 has a box-like shape and contains a plurality of paper sheets. The paper sheets are positioned in the feed tray 40 in accordance with the size thereof. In the printer 1, it becomes possible to supply the feed tray 40 with paper sheets by pulling the feed tray 40 outside, and it becomes possible to perform the print operation by attaching the feed tray 40 in the manner shown in FIG. 1.

Figure 5:
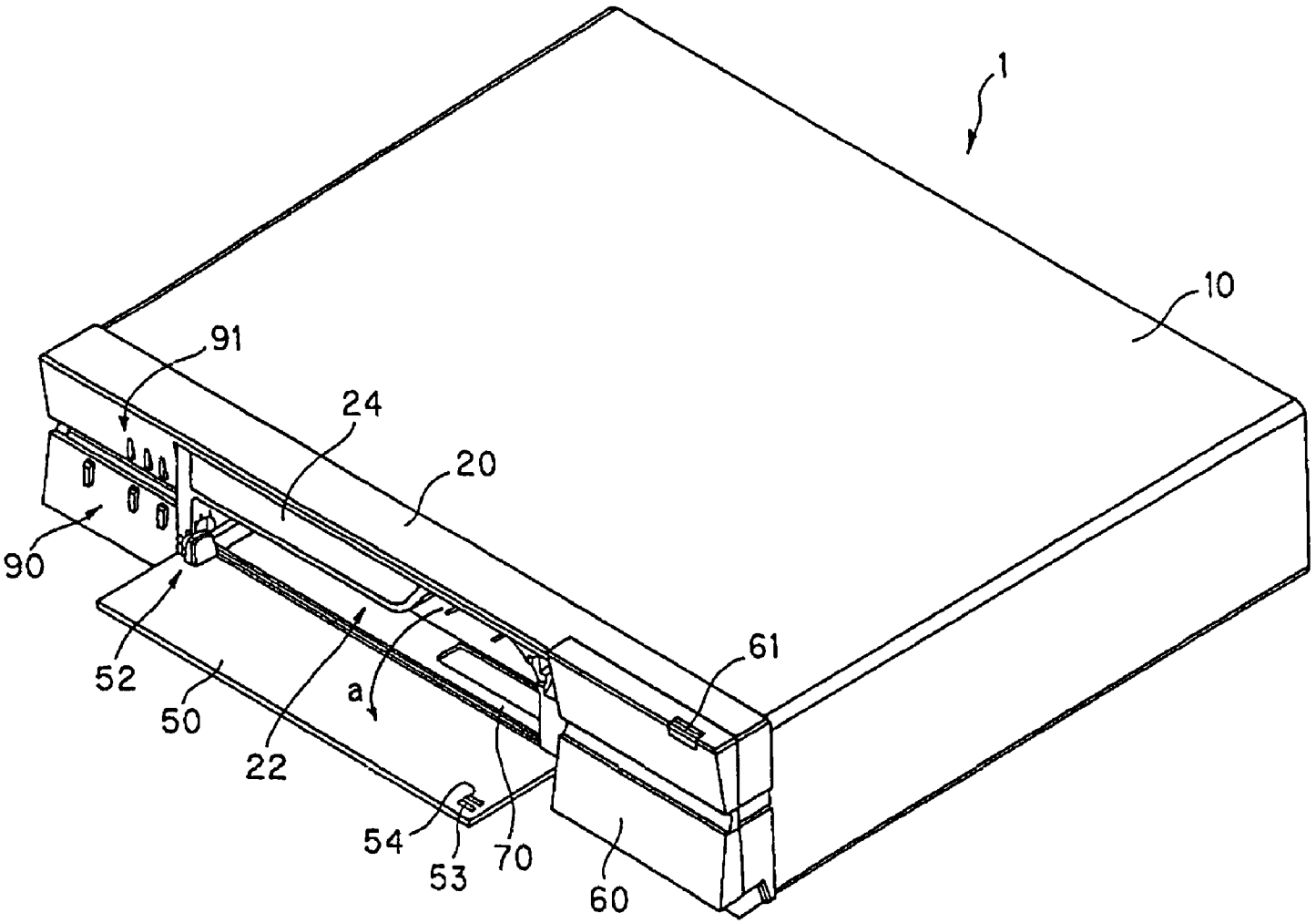
FIG. 5 is an external perspective view of the printer showing the manner in which an output door of the printer is opened.
Figure 6:
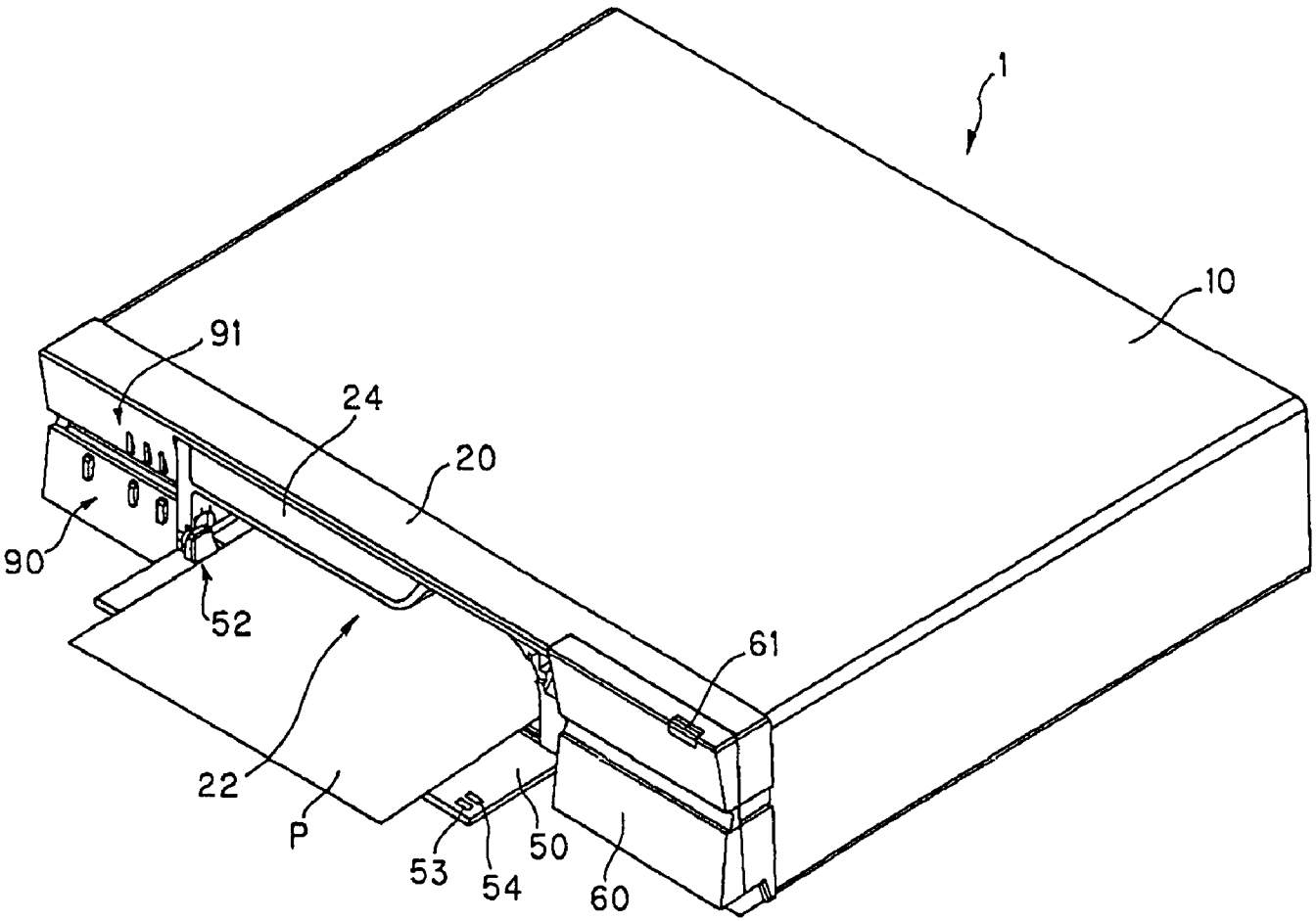
FIG. 6 is an external perspective view of the printer showing the manner in which a printed sheet is output through the output hole while the output door of the printer is open.

As shown in FIG. 1, the output door 50 has a plate shape with an approximately flat main surface, and is attached so as to cover the output hole 22 in the front panel 20. More specifically, the output door 50 is retained in such a manner that the output door 50 is in contact with the front panel 20 so as to cover the output hole 22 by an attractive force applied by a magnet (not shown) disposed in the main body 30 at a position behind a button 51 provided on the output door 50. In the printer 1, the output door 50 not only serves to greatly reduce the possibility that dust will enter the main body 30 through the output hole 22, but also provides a high-quality appearance. In addition, as described below, when the print operation is started, the output-door opening mechanism disposed in the main body 30 applies a driving force to the output door 50 against the magnetic attractive force applied by the magnet. Accordingly, as shown in FIG. 5, the output door 50 rotates around a gear unit 52 and opens in the direction shown by the arrow a by its own weight. The gear unit 52 is rotatably attached to the front panel 20 with a pin (not shown), and the output door 50 opens/closes by rotating around the pin. In the printer 1, while the output door 50 is open, the output hole 22 faces outward. As shown in FIG. 6, in the printer 1, a printed paper sheet P is output through the output hole 22 while the output door 50 is open, and is placed on the output tray 70, which will be described below, and the open output door 50. Accordingly, the output door 50 also serves as an auxiliary output tray for the output tray 70. When the print operation is finished, the user manually closes the output door 50 at a desired time. Alternatively, the output door 50 may also be closed automatically after confirming that no paper sheet is placed on the open output door 50.

Figure 7:
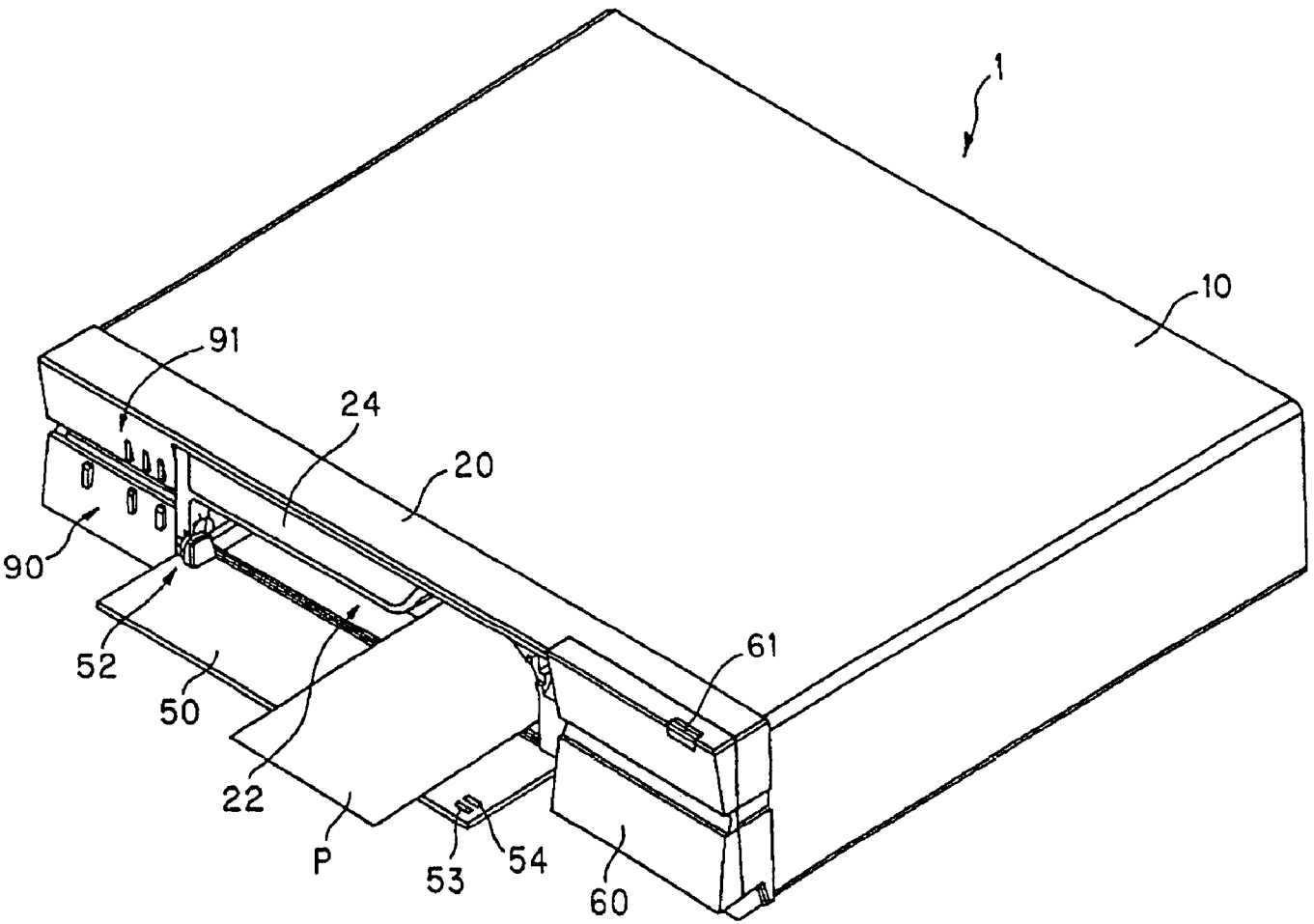
FIG. 7 is an external perspective view of the printer showing the manner in which a printed sheet whose width is considerably small compared to the longitudinal size of the output hole is output through the output hole.

In the printer 1, the position where the printed paper sheet is output is determined by using the right edge when the front panel 20 is viewed from the front as a reference. More specifically, in the printer 1, when a paper sheet having a relatively small width in the longitudinal direction of the output hole 22 is used, for example, when a postcard-size paper sheet is used, the paper sheet is stored on the feed tray 40 by using the right edge of the feed tray 40 as a reference, although not shown in the figure. Accordingly, as shown in FIG. 7, when the printed paper sheet P is output through the output hole 22, it is aligned at the right edge. Therefore, in the printer 1, paper jam during the paper output operation is likely to occur at the right side, especially when the size of the paper sheets is small, although it varies in accordance with other conditions. Thus, as shown in FIG. 2, the output hole 22 is formed to have a large vertical size at the right side. More specifically, in the printer 1, the optional-device attachment hole 24 is disposed at the upper left region of the output hole 22 instead of disposing it at the right side region of the output hole 22, so that a relatively large space is provided at the right side of the output hole 22. Accordingly, in the printer 1, a large maintenance space is provided for removing the paper sheet if it is jammed during the paper output operation, and even when a paper sheet of the smallest size is jammed, the user can easily take out the paper sheet. In addition, in the printer 1, a structure for guiding external illumination light into the main body 30 may be provided. For example, a mirror may be formed on a part or the entire region of the back surface of the output door 50, as described below. More specifically, the printer 1 may be constructed such that when the user inserts his or her hand into the main body 30 to remove the jammed paper sheet, external illumination light is guided into the main body 30 and the inside of the main body 30 is illuminated so that the user can easily view the inside of the main body 30.

Figure 8:
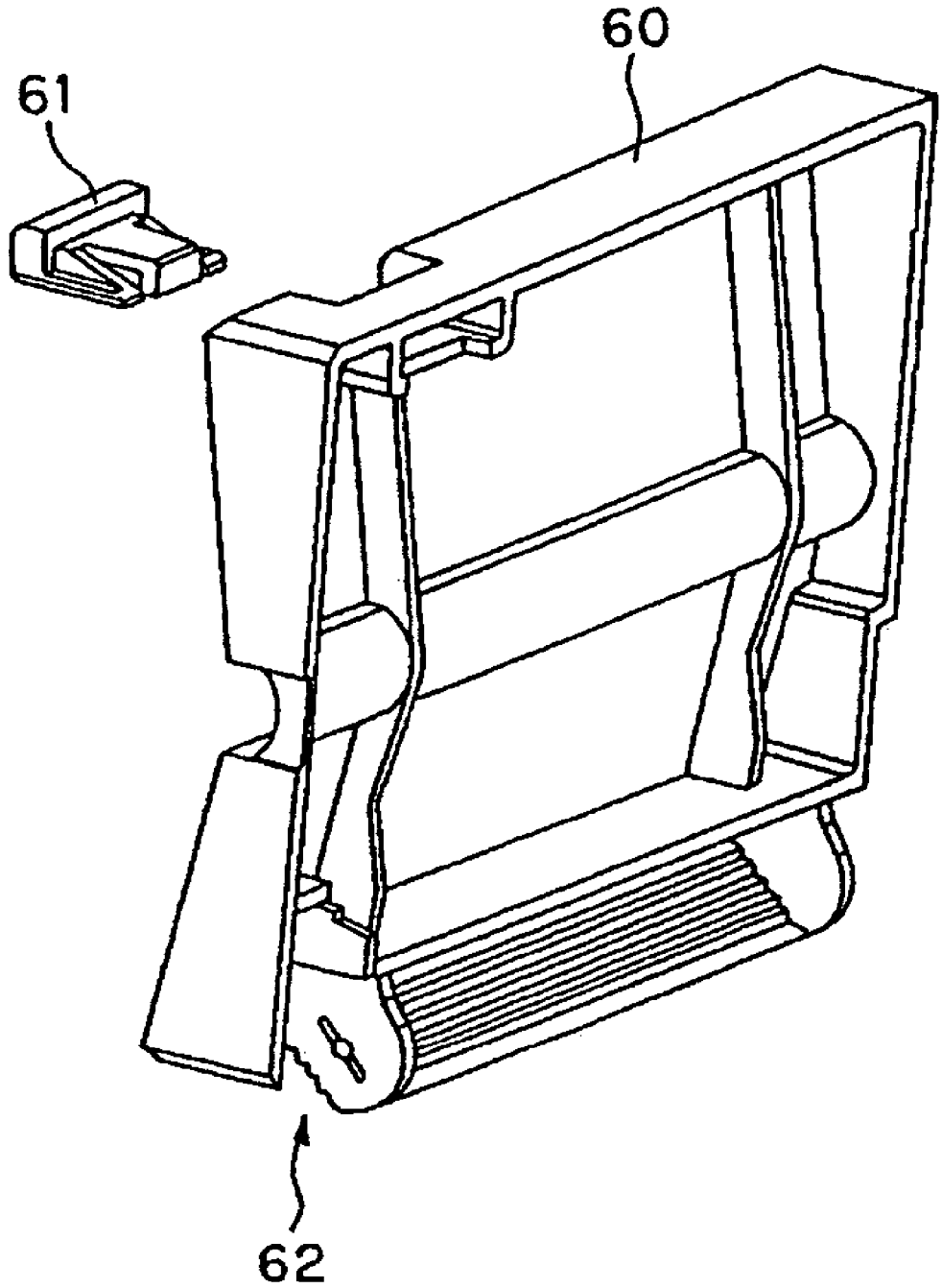
FIG. 8 is an exploded perspective view showing the construction of an ink-exchange door of the printer as viewed from the rear.
Figure 9:
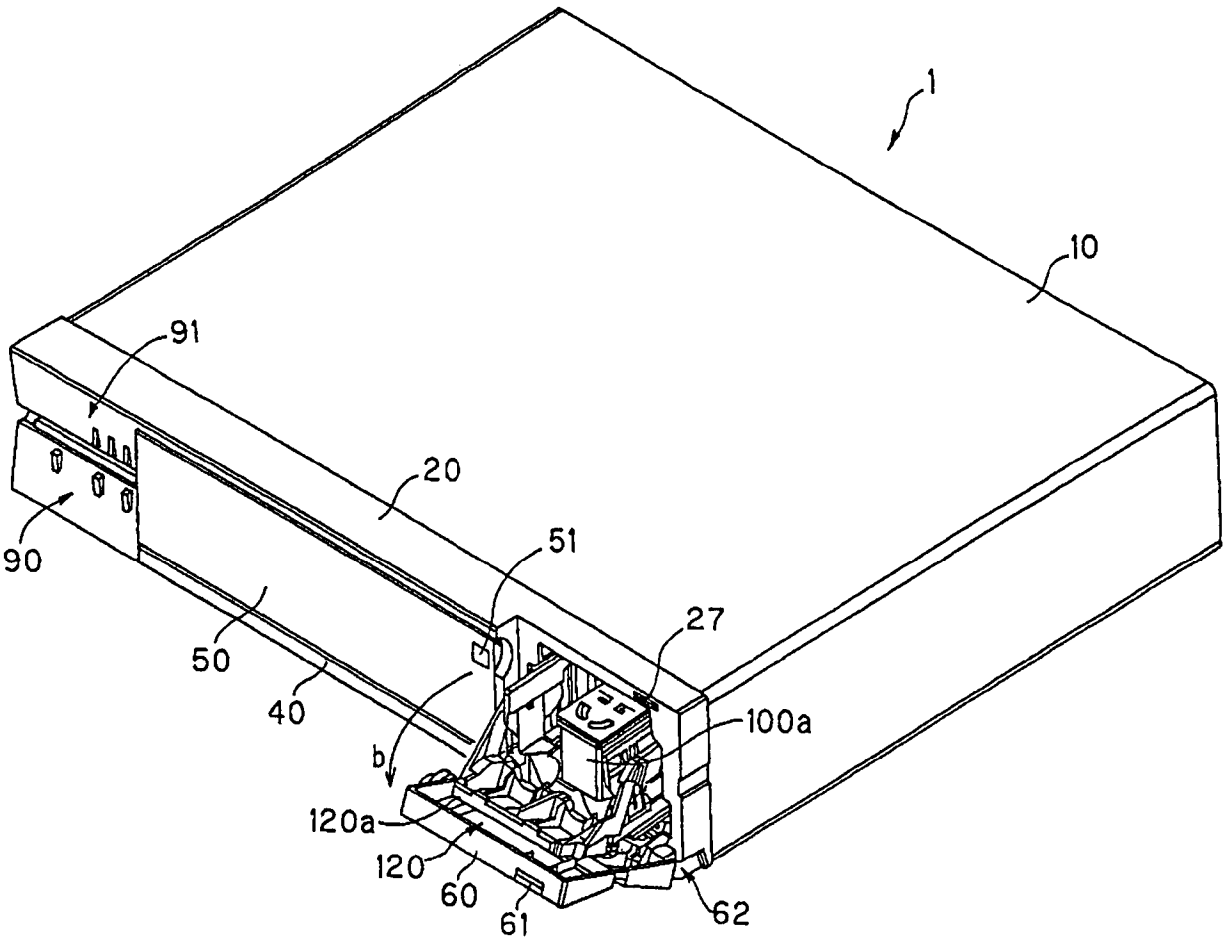
FIG. 9 is an external perspective view of the printer showing the manner in which the ink-exchange door is opened and an ink-exchange box to which an ink tank is attached faces outward.

As shown in FIG. 1, the ink-exchange door 60 has an approximately flat main surface, and is disposed so as to cover the ink-exchange hole 23 in the front panel 20. More specifically, a supporting portion 62 shown in FIG. 8 is rotatably attached to the front panel 20 with a pin (not shown), and the ink-exchange door 60 opens/closes by rotating around the pin. The state in which the exchange door 60 covers the ink-exchange hole 23 is established by inserting and fitting a push-in button 61 into a hole 27 formed in the front panel 20. FIG. 8 shows a rear view of the ink-exchange door 60. As shown in FIG. 9, when one or both of the ink tanks 100*a* and 100*b* are exchanged, the ink-exchange door 60 rotates around the supporting portion 62 and opens in the direction shown by the arrow b. More specifically, in the printer 1, when one or both of the ink tanks 100*a* and 100*b* are exchanged, the user pushes the push-in button 61. As described below, this activates the ink-tank driving mechanism 32 disposed in the main body 30, and an ink-exchange box 120, which is also disposed in the main body 30 and to which one or both of the ink tanks 100*a* and 100*b* are attached, is moved toward the ink-exchange hole 23. Then, in the printer 1, a side plate 120*a* of the ink-exchange box 120 which faces the ink-exchange hole 23 comes into contact with the ink-exchange door 60 and pushes the ink-exchange door 60 toward the outside. Accordingly, the ink-exchange door 60 opens as shown in the figure and the side plate 120*a* is released from other side plates of the ink-exchange box 120, so that the ink-exchange box 120, to which the ink tank 100*a* (and/or the ink tank 100*b*) is attached, faces outward. In this state, the desired ink tank is exchanged.

In the printer 1, the ink tank 100*a* for color printing which contains, for example, cyan, magenta, and yellow (CMY) inks and the ink tank 100*b* for monochrome printing which contains black (K) ink may be attached to the ink-exchange box 120.

In addition, in the printer 1, when the operation of exchanging the ink tank 100*a* (and/or the ink tank 100*b*) is finished, the user pushes the push-in button 61 again. As described below, this activates the ink-tank driving mechanism 32 disposed in the main body 30, and the ink-exchange box 120 is moved toward the ink-tank carriage 111 disposed in the main body 30. Accordingly, the ink-exchange door 60 closes and covers the ink-exchange hole 23, as shown in FIG. 1. In the printer 1, when the ink-exchange box 120 reaches the ink-tank carriage 111 in the main body 30, the ink tanks 100*a* and 100*b* are attached to the ink tank carriage 111. In addition, in the printer 1, the lock mechanism disposed in the main body 30, which will be described below, locks the ink-exchange door 60 so that the ink-exchange door 60 cannot be opened manually by the user while the ink-exchange door 60 covers the ink-exchange hole 23.

Figure 10:
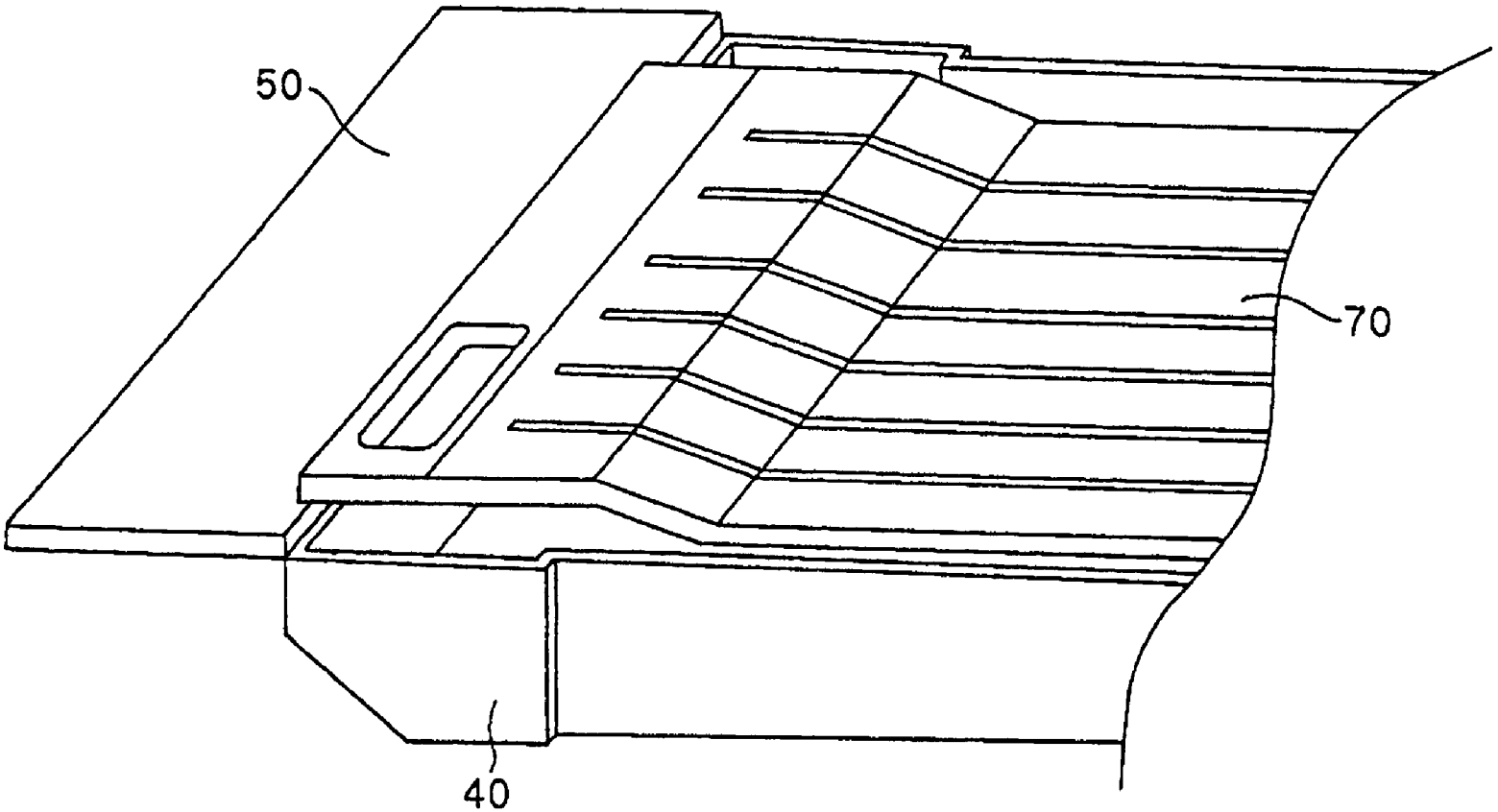
FIG. 10 is a perspective view of the main part of the printer showing an output tray included in the printer.
Figure 11:
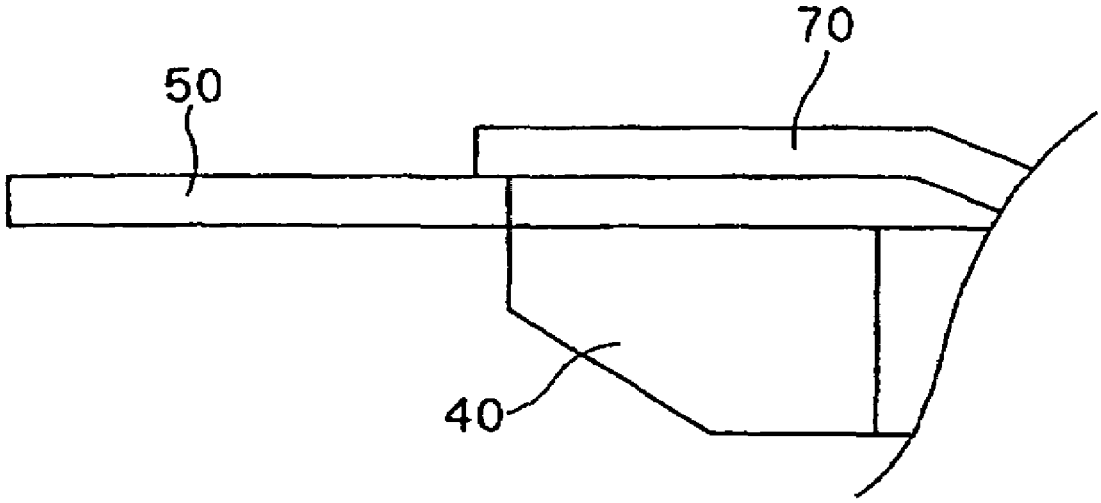
FIG. 11 is a sectional view of the main part of the printer showing the output tray.
Figure 12:
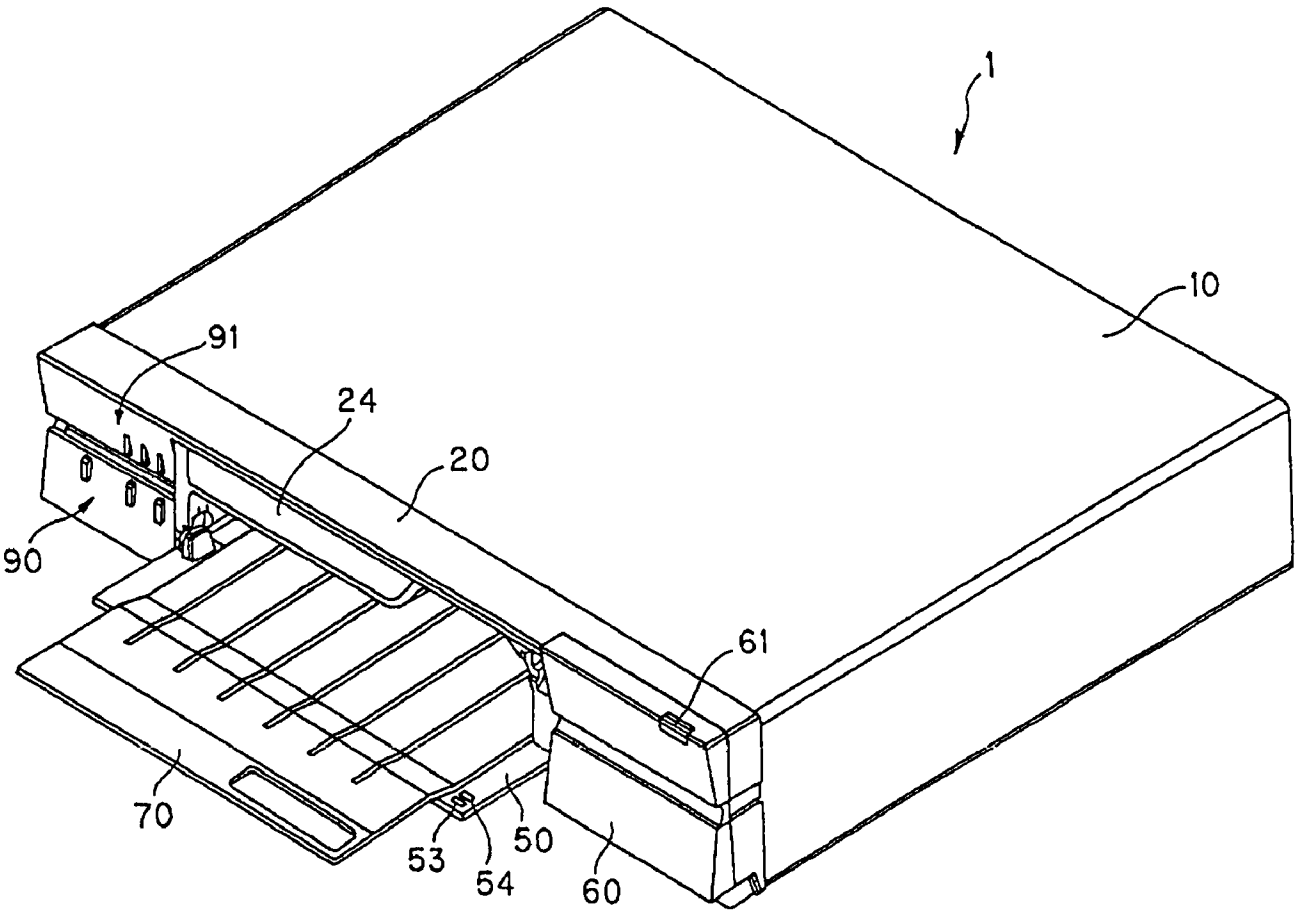
FIG. 12 is an external perspective view of the printer showing the manner in which the output tray is attached/detached to/from the main body of the printer.

As shown schematically in FIG. 10, the output tray 70 is normally placed on the feed tray 40, which is attached to the main body 30 (not shown), so as to cover the main surface of the feed tray 40, and forms a paper output path of the printed paper sheet, which is conveyed from the right in the figure, in combination with the open output door 50. As shown in FIG. 11, an edge portion of the output tray 70 that is close to the output door 50 overlaps an edge portion of the open output door 50. In addition, the top surface of the output tray 70 is positioned higher than the top surface of the open output door 50. In the printer 1, since the edge portion of the output tray 70 overlaps the edge portion of the output door 50 in the vertical direction, no gap is provided between the output tray 70 and the output door 50. In addition, since the top surface of the output tray 70 is positioned higher than the top surface of the output door 50, the printed paper sheet can be prevented from being stopped by a step formed at the boundary between the output tray 70 and the output door 50. Accordingly, in the printer 1, the paper sheet can be output smoothly. In addition, as shown in FIG. 12, the output tray 70 can be detached from the main body 30 by pulling it out through the output hole 22 in the front panel 20. In addition, as shown in FIG. 12, the output tray 70 is attached in such a manner that a part of the output tray 70 projects outward from the main body 30, so that even when a paper sheet which is relatively long in the paper-output direction is used, the paper sheet can be prevented from falling down from the printer 1.

Figure 13:
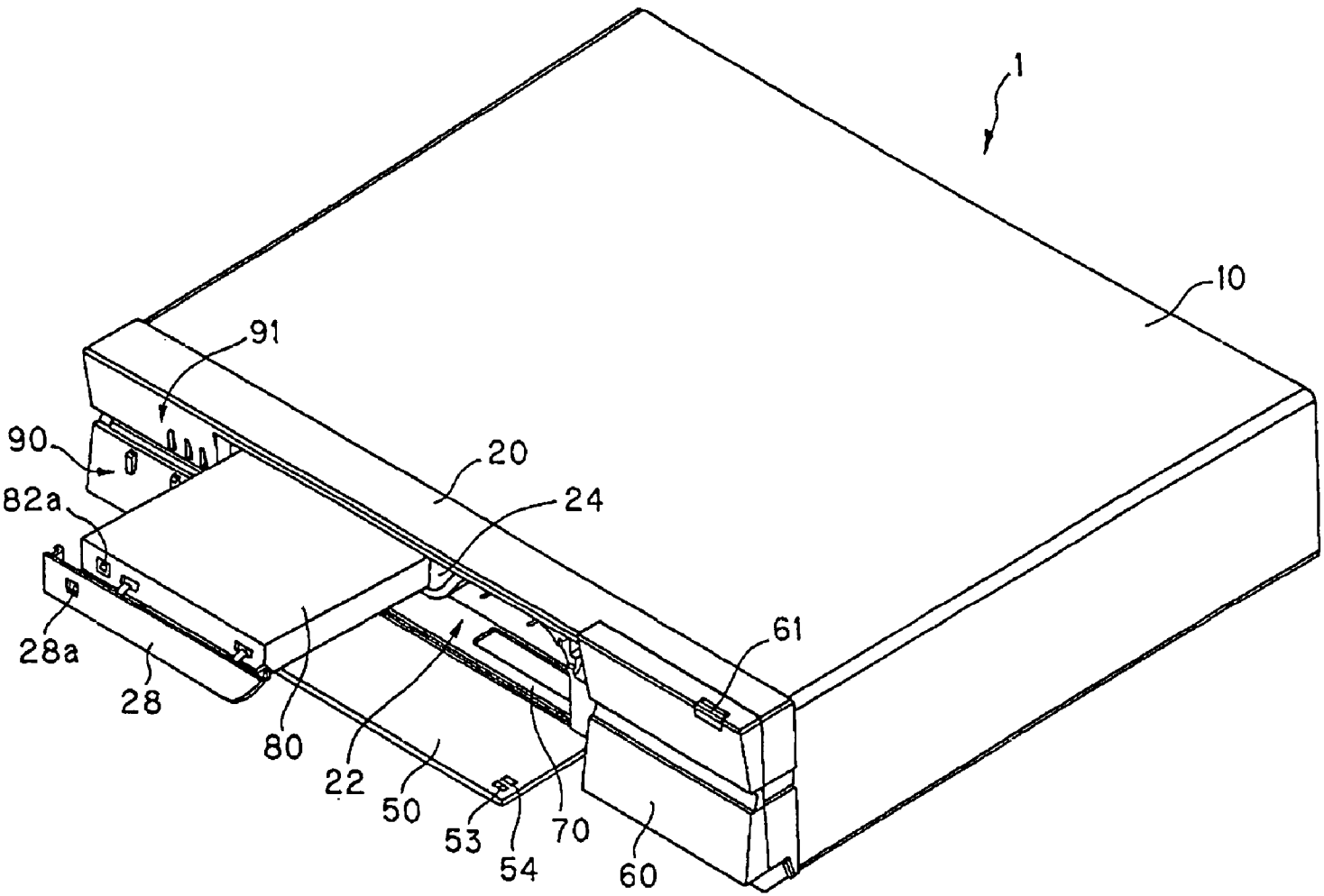
FIG. 13 is an external perspective view of the printer showing the manner in which an optional device is attached/detached to/from the main body of the printer.

The optional device 80 is attached to the main body 30 as necessary, as described in detail below. The optional device 80 may be, for example, an expansion unit which functions as an interface between the printer 1 and an external device. The optional device 80 is constructed by covering a substrate (not shown) with a metal housing having a shielding ability. As shown in FIG. 13, the optional device 80 can be inserted through the optional-device attachment hole 24 in the front panel 20 and be detachably attached to a slot (not shown) which is disposed in the main body 30 and fixed to the front panel 20. A panel 28 having approximately the same shape as that of the optional-device attachment hole 24 is attached to the optional device 80, and the optional device 80 is attached/detached to/from the slot by using the panel 28, as described below.

Figure 14:
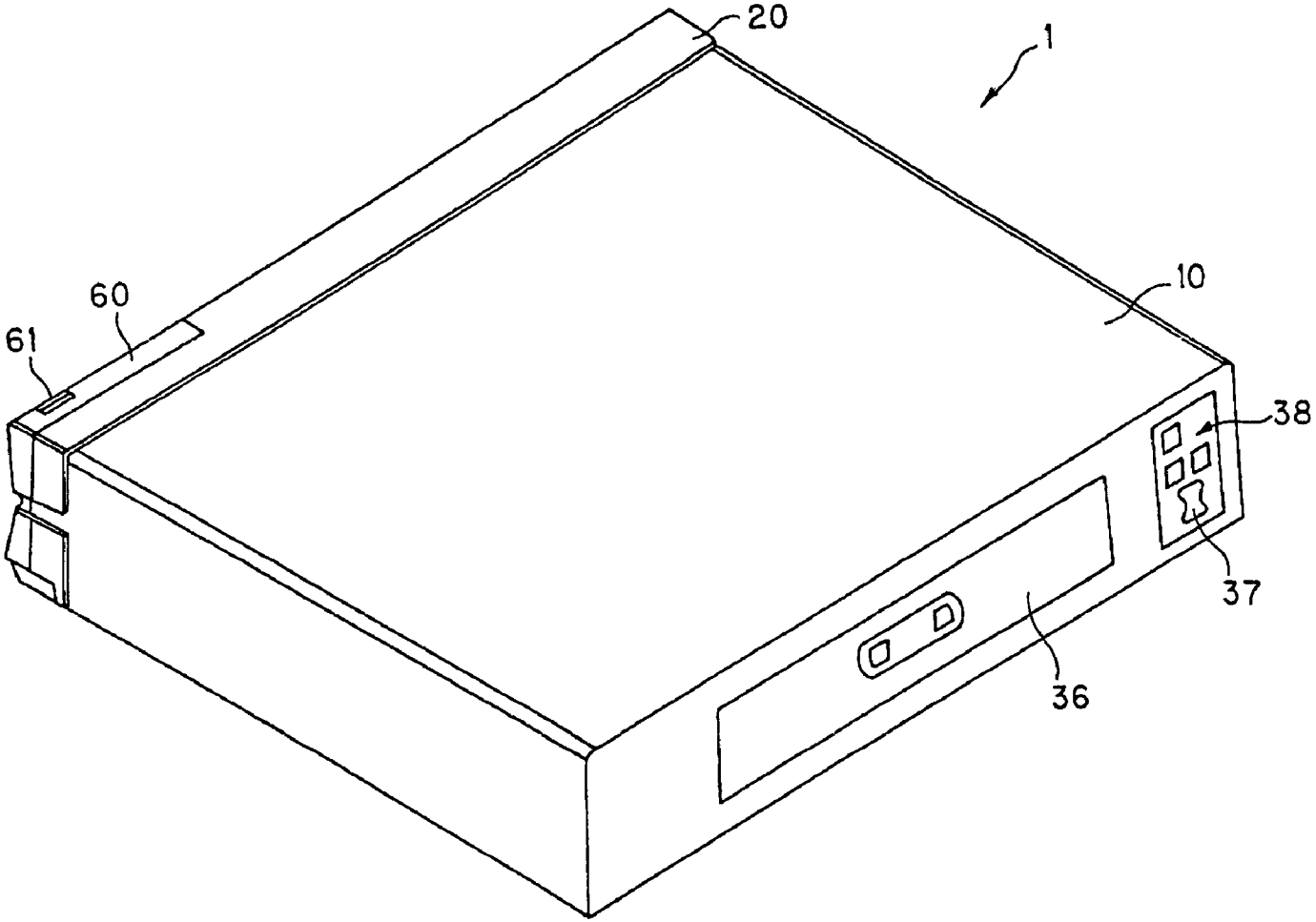
FIG. 14 is an external perspective view of the printer as viewed from the rear.
Figure 15:
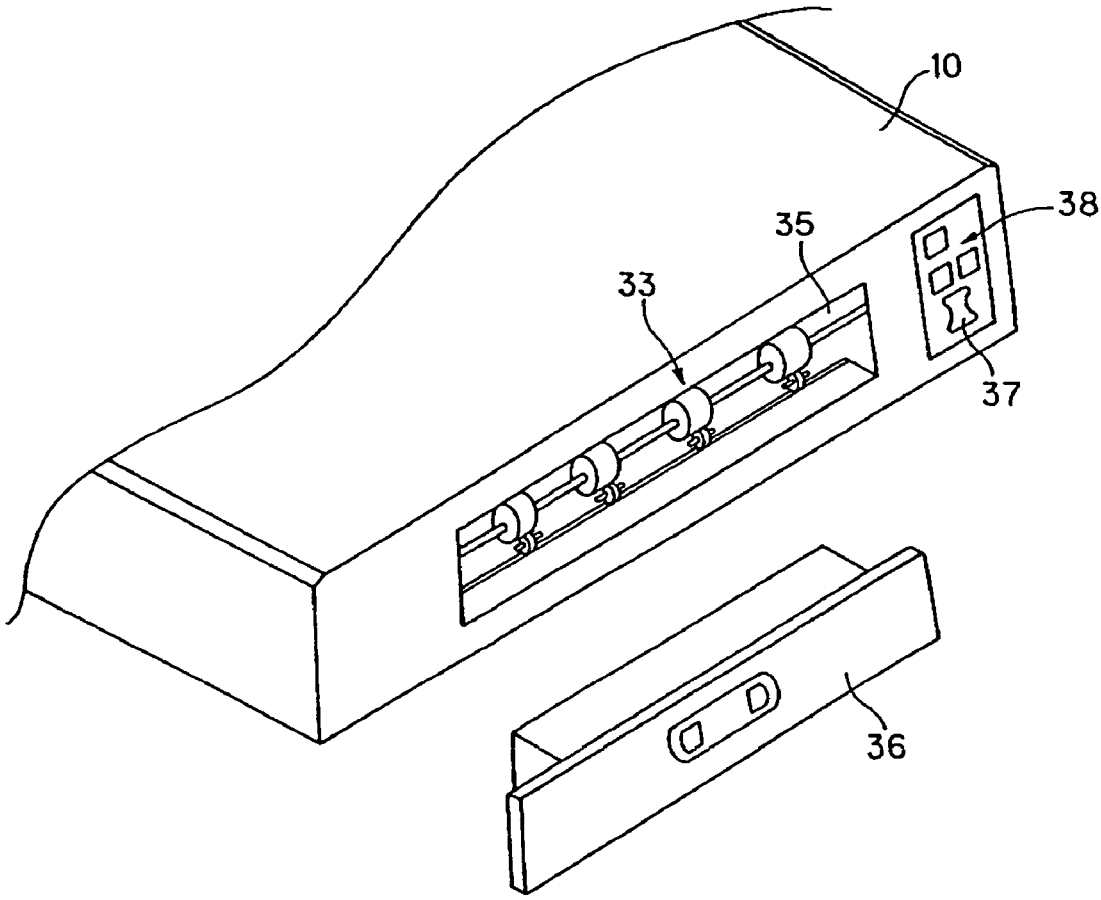
FIG. 15 is an external perspective view of the printer showing the manner in which a cover is removed so that a paper-reversing mechanism disposed in the main body of the printer can be viewed from the outside.

In addition, as shown in FIG. 14, the printer 1 is provided with a cover 36 for covering the above-described paper-removing hole 35 in the rear surface of the printer 1. The cover 36 is detachable from the main body 30, and, as shown in FIG. 15, when the cover 36 is removed, the above-described paper-reversing mechanism 33 for conveying the paper sheet supplied from the feed tray 40 toward the paper output path can be viewed from the outside. When the paper sheet is jammed in the main body 30 before it is conveyed toward the paper output path, the user can remove the cover 36, insert his or her hand through the paper-removing hole 35, and remove the jammed paper sheet.

In addition, the printer 1 has a power-cord receptacle 37 into which a power cord is inserted on the rear surface thereof. The printer 1 receives electric power supplied from a house outlet (plug socket) via the power-cord receptacle 37. In addition, the printer 1 also has a bus-connector group 38 for providing connection to a Universal Serial Bus (USB), a serial bus which is compliant with IEEE 1394 for which various standards are proposed on the basis of IEEE Standard for a High Performance Serial Bus (IEEE Std. 1394-1995) approved by Institute of Electrical and Electronics Engineers (IEEE), etc. The printer 1 may be connected to a host computer, etc., via the bus connector group 38 so that it can receive data of image to be printed and transmit/receive various control signals.

Next, driving mechanisms disposed in the main body 30 will be described below.

Figure 16:
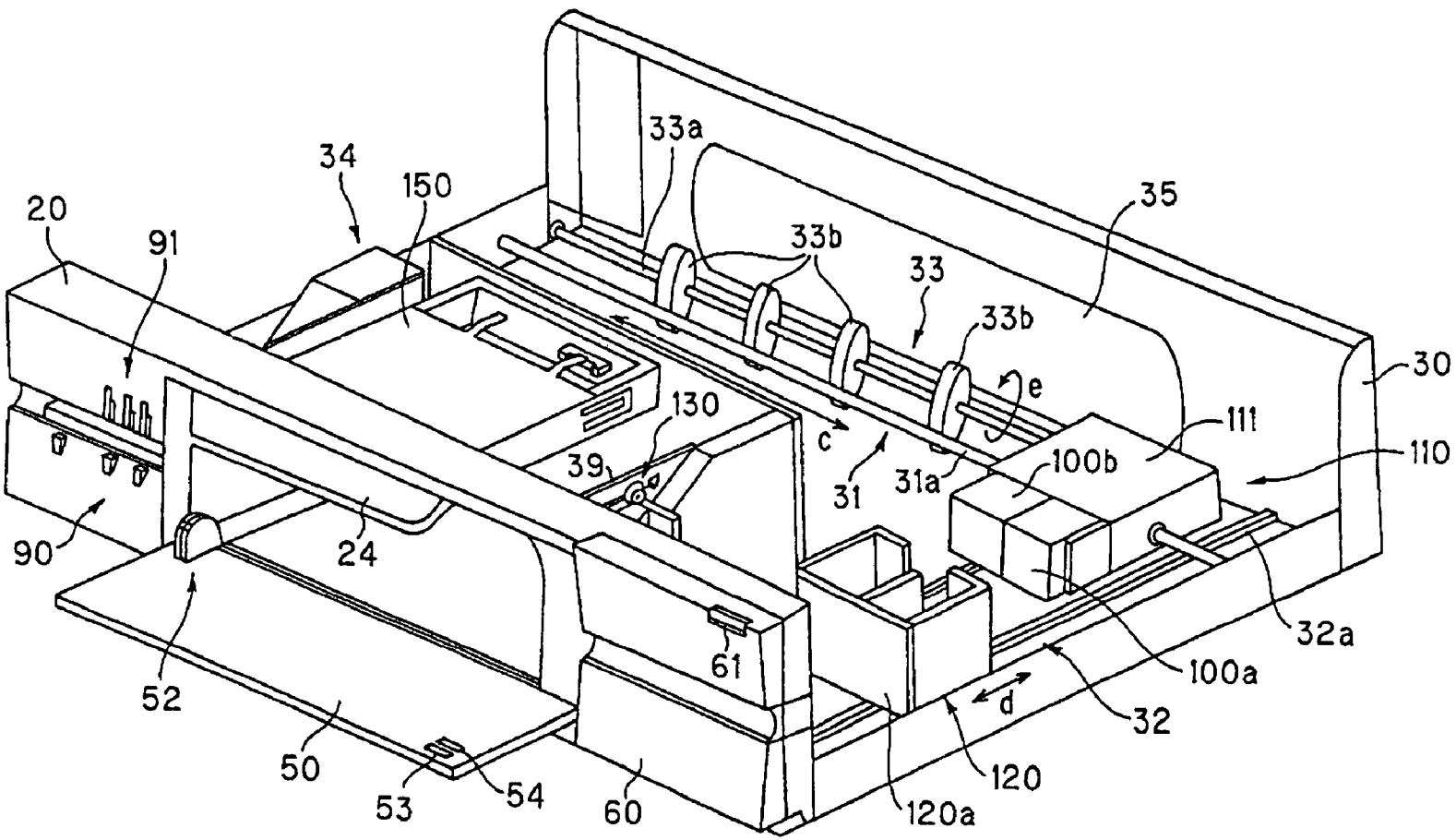
FIG. 16 is a perspective view showing the internal construction of the printer.

As show in FIG. 16, the main body 30 includes the head-unit driving mechanism 31, the ink-tank driving mechanism 32, and the paper-reversing mechanism 33, as driving mechanisms.

The head-unit driving mechanism 31 reciprocates the head unit 110 in the direction shown by the arrow c in the figure along a shaft 31*a* which extends to both sides of the main body 30 by using a drive motor (not shown), etc., as a drive source. More specifically, when the print operation is not performed, the head-unit driving mechanism 31 moves the head unit 110 to the right side where the ink-tank driving mechanism 32, which will be described below, is placed in the main body 30, as shown in the figure. The position of the head unit 110 as seen in the figure is the home position thereof. When the print operation is performed, the head-unit driving mechanism 31 reciprocates the ink-tank carriage 111 in the direction shown by the arrow c in the figure. Accordingly, in the printer 1, serial printing is performed by reciprocating the head unit 110, to which the ink tanks 100*a* and 100*b* are attached, along the width direction of the paper sheet in a printing section which extends along the shaft 31*a* of the head-unit driving mechanism 31. In the printer 1, each of the ink tanks 100*a* and 100*b* includes driving elements (not shown) controlled by a control unit (not shown) disposed in the main body 30, and ink is discharged from nozzles (not shown) while the amount of discharge is controlled in accordance with the movement of the driving elements.

With reference to FIG. 16, the ink-tank driving mechanism 32 reciprocates the ink-exchange box 120 in the direction shown by the arrow d in the figure along a rail 32*a* extending from the front to the rear of the main body 30. More specifically, as described above, the ink-tank driving mechanism 32 is activated when the user pushes the push-in button 61, attaches one or both of the ink tanks 100*a* and 100*b* which are to be exchanged to the ink-exchange box 120, and moves the ink-exchange box 120 toward the ink-exchange hole 23. The ink-tank driving mechanism 32 moves the ink-exchange box 120 from the position closest to the head unit 110 to the position where the ink-exchange box 120 faces outward in several seconds. When the operation of exchanging one of both of the ink tanks 100*a* and 100*b* is finished, the user pushes the insertion button 61 to activate the ink-tank driving mechanism 32 again, and the ink-tank driving mechanism 32 moves the ink-exchange box 120 toward the head unit 110. In addition, the ink-tank driving mechanism 32 is attached to a mechanism which, when a predetermined load is applied while the ink-exchange box 120 is being moved toward the head unit 110, detects the load and stops the movement of the ink-exchange box 120. Accordingly, in the printer 1, even if the ink-exchange door 60 starts to close when, for example, the user's finger is still inside the ink-exchange hole 23, the movement of the ink-exchange box 120 is stopped immediately and the ink-tank driving mechanism 32 operates to open the ink-exchange door 60.

In addition, while the print operation is performed, the ink-tank driving mechanism 32 moves the ink-exchange box 120 in the direction shown by the arrow d in the figure in order to activate an output-door opening mechanism 130, which is partially shown in the figure. More specifically, in the printer 1, the drive power for opening the output door 50 when the print operation is started is generated by the movement of the ink-exchange box 120. The output-door opening mechanism 130 will be described below.

The ink-tank driving mechanism 32 includes the above-described lock mechanism, and opens the ink-exchange door 60 in accordance with the position of the ink-exchange box 120. More specifically, the ink-tank driving mechanism 32 prevents the exchange door 60 from being opened manually by the user except for when one or both of the ink tanks 100*a* or 100*b* are exchanged. The lock mechanism will also be described below.

Figure 17:
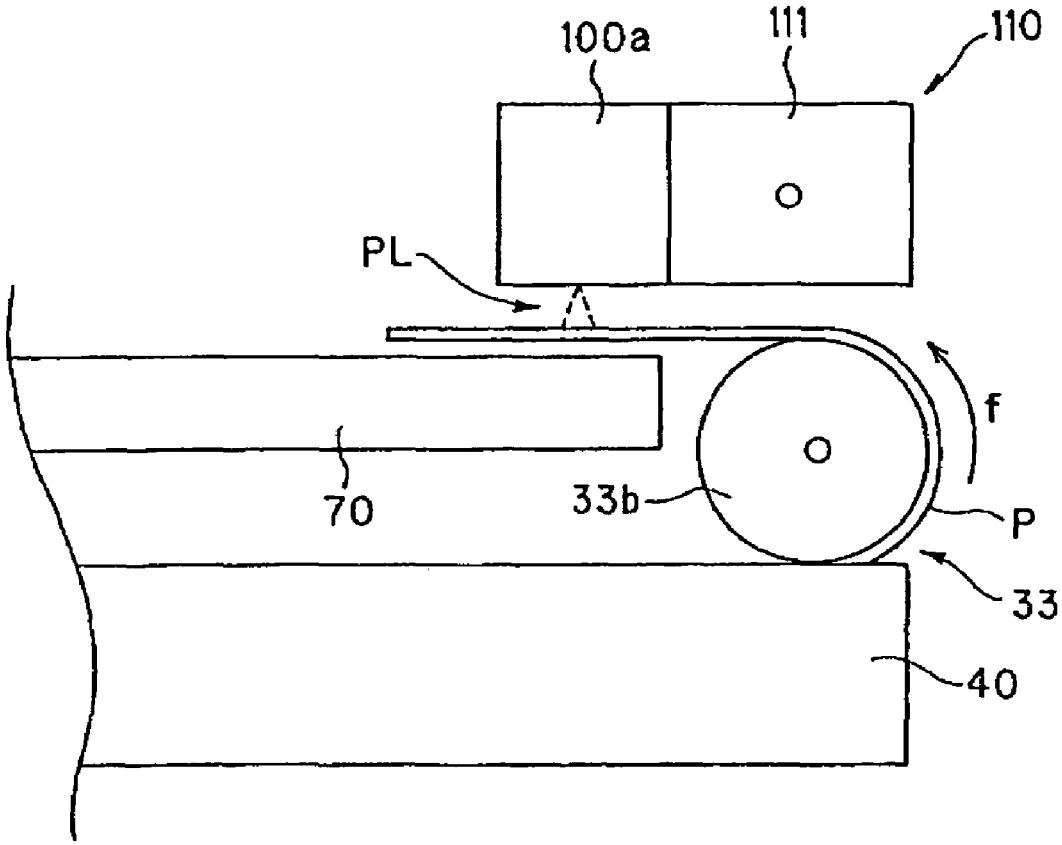
FIG. 17 is a sectional view of the main part of the printer showing the manner in which the paper-reversing mechanism operates.

When the print operation starts, the paper-reversing mechanism 33 rotates rollers 33*b* which are attached to a shaft 33*a*, which extends to both sides of the main body 30, in the direction shown by the arrow e in the figure by using a drive motor (not shown), etc., as a drive source. More specifically, as shown in FIG. 17, the paper-reversing mechanism 33 rotates the rollers 33*b* in the direction shown by the arrow f in the figure, and the paper sheet P supplied from the feed tray 40 is moved around the rollers 33*b* so that it is reversed, and is conveyed from the rollers 33*b* toward the printing unit PL of the head unit 110. The paper-reversing mechanism 33 rotates the rollers 33*b* by a predetermined angle every time the head unit 110 is moved by the head-unit driving mechanism 31 and a single line is printed on the paper sheet P by ink drops discharged from the ink tanks 100*a* and 100*b*. In this manner, the paper-reversing mechanism 33 rotates the rollers 33*b* and conveys the paper sheet P toward the paper output path by a predetermined distance every time a single line is printed on the paper sheet P.

The print operation of the printer 1 having the above-described components will be described below.

First, in the printer 1, the user turns on the power by pushing the power switch included in the switch group 90 which faces outward on the front panel 20, pulls out the feed tray 40 through the feed-tray attachment hole 21 in the front panel 20, places a stack of paper sheets on the feed tray 40, and attaches the feed tray 40 to the main body 30 by pushing in the feed tray 40. Accordingly, in the printer 1, the rollers 33*b* of the paper-reversing mechanism 33 presses the stack of paper sheets at the end of the paper sheets. If necessary, the user pushes the push-in button 61 and activate the ink-tank driving mechanism 32 so as to open the ink-exchange door 60 of the front panel 20, and exchange one or both of the ink tanks 100*a* and 100*b*.

In the printer 1, when above-described preparation processes are completed and the print operation starts, the output-door opening mechanism 130 is activated so as to open the output door 50. In addition, the rollers 33*b* are rotated by the paper-reversing mechanism 33, so that a single paper sheet is supplied from the feed tray 40.

Then, in the printer 1, the paper sheet is reversed and conveyed toward the printing unit by the paper-reversing mechanism 33. Then, the head-unit driving mechanism 31 starts to operate at a predetermined time and moves the head unit 110, and ink drops are discharged from the nozzles (not shown) of the ink tanks 100*a* and 100*b* toward the paper sheet. Accordingly, information including characters and/or images is formed on the paper sheet by dots. In addition, in the printer 1, the paper-reversing mechanism 33 sequentially conveys the paper sheets and outputs them through the output hole 22 in the front panel 20, and the paper sheets are placed on the output tray 70 and the open output door 50.

In this manner, the printer 1 forms images on the paper sheets. Since all of the main operations of the printer 1 can be performed through the front panel 20, the flat, top surface can be utilized freely. For example, an object can be placed on the top surface. More specifically, the printer 1 can be stacked together with other AV devices.

As described above, the printer 1 has the lamp group 91 which includes the warning lamp which indicates that the paper sheet is jammed in the main body 30. This warning lamp can also indicate whether the paper jam has occurred before the print operation, or during or after the-print operation. More specifically, the warning lamp can indicate whether the paper jam has occurred during the paper feed operation or during the paper output operation. The printer 1 includes at least one detector, such as a sensor, which detects paper jam and determines whether the paper jam has occurred before the print operation, or during or after the print operation. Examples of detecting methods will be described below.

According to a first method, at least one sensor is provided for detecting the position of the paper sheet in the paper-conveying direction with respect to the above-described printing unit PL, and the position where the paper jam has occurred is detected by this sensor.

Figure 18:
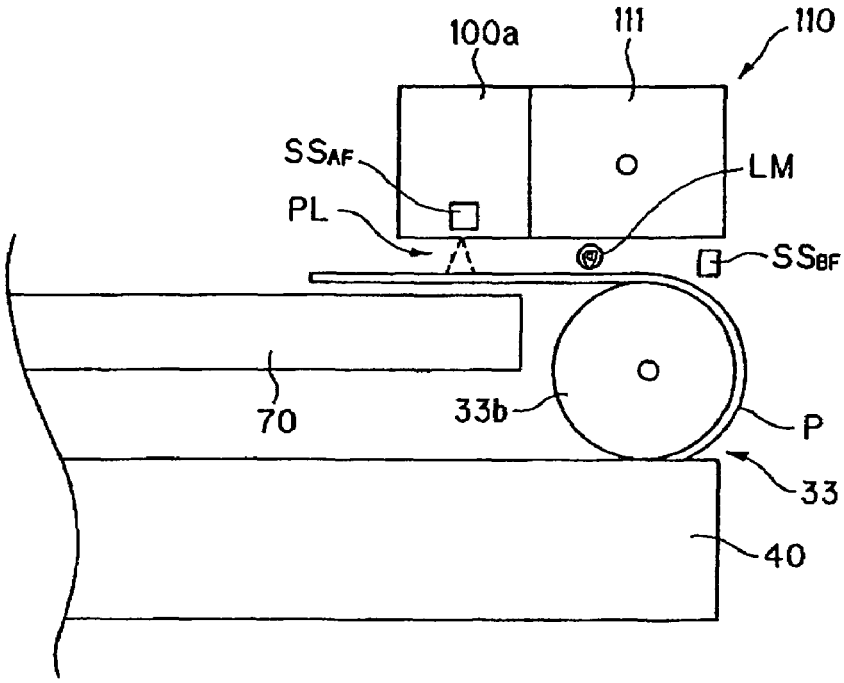
FIG. 18 is a sectional view of the main part of the printer showing the manner in which a sensor which detects the occurrence of paper jam and a lamp for maintenance which emits light when paper jam occurs are disposed.

For example, as shown in FIG. 18, a sensor $SS_{BF}$ may be disposed along a path of the paper sheet P which is reversed by the paper-reversing mechanism 33. The sensor $SS_{BF}$ detects the presence/absence of the paper sheet P at a position corresponding to the position where the sensor $SS_{BF}$ is placed, and transmits an error signal when the paper sheet P does not reach the corresponding position in a predetermined time or when the paper sheet P does not leave the corresponding position after a predetermined time.

In the printer 1, when the paper sheet P is supplied from the feed tray 40, it is normally output after a predetermined time. Accordingly, in the printer 1, when the sensor $SS_{BF}$ determines that the paper sheet P has not reached the corresponding position in the predetermined time after being supplied from the feed tray 40, or when the sensor $SS_{BF}$ determines that the paper sheet P has not left the corresponding position after the predetermined time, it is determined that paper jam has occurred before the print operation, that is, during the paper-feed operation, and the error signal is generated by the sensor $SS_{BF}$. Then, in the printer 1, the electric control unit 34 controls the light-emitting operation of the warning lamp included in the lamp group 91 in accordance with the error signal obtained from the sensor $SS_{BF}$.

In addition, in the printer 1, when the paper sheet P passes by the sensor $SS_{BF}$ and reaches the printing unit PL, the head-unit driving mechanism 31 moves the head unit 110 so as to start the print operation. When, for example, an abnormal operation occurs and the print operation and the paper-output operation are stopped, the printer 1 determines that the paper jam has occurred during the print operation, that is, during the paper-output operation, and the electric control unit 34 controls the light-emitting operation of the warning lamp in a manner different from the above-described case in which the paper jam has occurred during the paper-feed operation. For example, in the printer 1, the light emission pattern, that is, intervals at which light is emitted, etc., and/or the color of light of the warning lamp are changed in accordance with whether the paper jam has occurred before the print operation or during the print operation. Alternatively, the printer 1 may be provided with a plurality of warning lamps which are turned on in correspondence with whether the paper jam has occurred before the print operation or during the print operation.

In addition, in the printer 1, it is not necessary to use as the sensor $SS_{BF}$ the sensor which is disposed at a position along the path of the paper sheet P reversed by the paper-reversing mechanism 33 and which detects the presence/absence of the paper sheet P at the corresponding position. Alternatively, a sensor which detects the load applied to the drive motor (not shown) which serves as the drive source for the paper-reversing mechanism 33 may also be used. When paper jam occurs in the printer 1, the operation of the paper-reversing mechanism 33 is usually impeded by the jammed paper, etc., and the load applied to the drive motor increases accordingly. Therefore, when the sensor $SS_{BF}$ detects that a load larger than a predetermined load is applied to the drive motor, it is determined that the paper jam has occurred before the print operation. Then, the paper-feed operation is stopped and the error signal is generated by the sensor $SS_{BF}$.

Accordingly, the printer 1 may include at least one sensor $SS_{BF}$ which determines the position of the paper sheet in the paper-conveying direction with respect to the printing unit PL, and the position where the paper jam has occurred may be detected by the sensor $SS_{BF}$. Whether the paper jam has occurred before the print operation or during the print operation is indicated by controlling the light-emitting operation of the warning lamp on the basis of the error signal generated by the sensor $SS_{BF}$.

Next, a second method will be described below. According to the second method, at least one sensor is prepared in addition to the above-described sensor $SS_{BF}$ used in the first method, and the position where the paper jam has occurred is detected by using these sensors.

More specifically, as shown in FIG. 18, the sensor $SS_{BF}$ is disposed along the path of the paper sheet P which is reversed by the paper-reversing mechanism 33, and another sensor $SS_{AF}$ is disposed at a position close to the printing unit PL. Each of the sensors $SS_{BF}$ and $SS_{AF}$ detects the presence/absence of the paper sheet P at a position corresponding to the position where each of the sensors $SS_{BF}$ and $SS_{AF}$ is placed, and transmits an error signal when the paper sheet P does not reach the corresponding position in a predetermined time or when the paper sheet P does not leave the corresponding position after a predetermined time.

In the printer 1, when the sensor $SS_{BF}$ detects that the paper jam has occurred before the print operation, an error signal is generated by the sensor $SS_{BF}$, as described above.

In addition, in the printer 1, when the paper sheet P passes by the sensor $SS_{BF}$ and reaches the position corresponding to the sensor $SS_{AF}$, the head-unit driving mechanism 31 moves the head unit 110 so as to start the print operation. Accordingly, in the printer 1, when the sensor $SS_{AF}$ determines that the paper sheet P had reached the printing unit PL in a predetermined time, but has not left the corresponding position after a predetermined time, it is determined that the paper jam has occurred during or after the print operation, that is, during the paper-output operation, and the error signal is generated by the sensor $SS_{AF}$.

Figure 19:
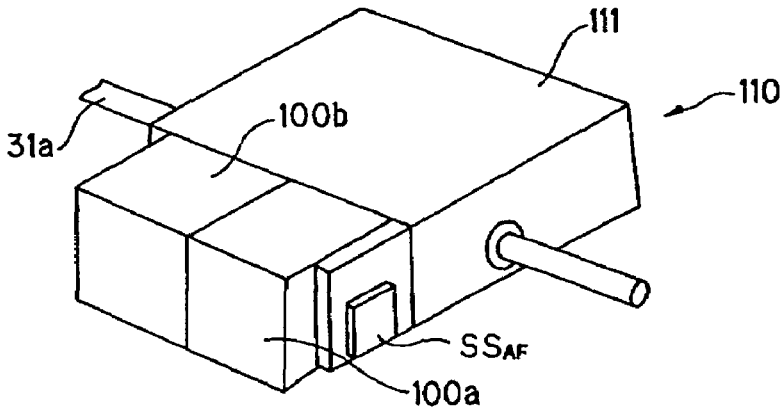
FIG. 19 is a perspective view of a head unit disposed in the main body of the printer showing the manner in which a sensor which detects the kind of the paper sheet is disposed as a substitute for a sensor which detects the occurrence of paper jam during or after the printing operation.

In the printer 1, a sensor for detecting the kind of the paper sheet to be printed may be used as the sensor $SS_{AF}$, as shown in FIG. 19. In this case, the sensor $SS_{AF}$ for detecting the width of the paper sheet to be printed is provided on the ink-tank carriage 111 of the head unit 110 at a position corresponding to the printing unit PL, and the head-unit driving mechanism 31 moves the head unit 110 to a predetermined position in correspondence with the detection result obtained by the sensor $SS_{AF}$ before starting the print operation. The printer 1 may determine whether or not the paper jam has occurred during the paper-output operation by using this sensor $SS_{AF}$.

In addition, in the printer 1, it is not necessary to use as the sensor $SS_{AF}$ the sensor which is disposed at a position close to the printing unit PL and which detects the presence/absence of the paper sheet P at the corresponding position. Alternatively, a sensor which detects the load applied to the drive motor (not shown) which serves as the drive source for the head-unit driving mechanism 31 may also be used. When paper jam occurs in the printer 1, not only the operation of the paper-reversing mechanism 33 but also the operation of the head-unit driving mechanism 31 is impeded, and the load applied to the drive motor increases accordingly. Accordingly, when the sensor $SS_{AF}$ detects that a load larger than a predetermined load is applied to the drive motor, it is determined that the paper jam has occurred during or after the print operation. Then, the paper-feed operation is stopped and the error signal is generated by the sensor $SS_{AF}$.

In the printer 1, the electric control unit 34 controls the light-emitting operation of the warning lamp included in the lamp group 91 on the basis of the error signals obtained by the sensors $SS_{BF}$ and $SS_{AF}$. For example, in the printer 1, the light emission pattern, that is, intervals at which light is emitted, etc., and/or the color of light of the warning lamp are changed in accordance with whether the paper jam has occurred before the print operation, or during or after the print operation. Alternatively, the printer 1 may be provided with a plurality of warning lamps which are turned on in correspondence with whether the paper jam has occurred before the print operation, or during or after the print operation.

Accordingly, the printer 1 may include at least two sensors $SS_{BF}$ and $SS_{AF}$ which determine the position of the paper sheet in the paper-conveying direction with respect to the printing unit PL, and the position where the paper jam has occurred may be detected by these sensors $SS_{BF}$ and $SS_{AF}$. Whether the paper jam has occurred before the print operation, or during or after the print operation is indicated by controlling the light-emitting operation of the warning lamp on the basis of the error signals obtained by the sensors $SS_{BF}$ and $SS_{AF}$.

Next, a third method will be described below. According to the third method, at least one sensor which detects the occurrence of paper jam and a sensor which detects whether or not the printing signal has been generated are provided, and the position where the paper jam has occurred is determined by combining the detection results obtained by these sensors.

More specifically, the printer 1 detects the occurrence of paper jam by using at least one of the above-described sensors disposed along the paper feed path and the paper output path, the sensors which detect the loads applied to the driving motors of the head-unit driving mechanism 31 and the paper-reversing mechanism 33. In this case, it is not necessary for the sensor itself to determine the position where the paper jam has occurred, and the sensor needs simply to detect that the paper jam has occurred. Then, the printer 1 determines whether or not the printing signal has been generated, that is, whether or not the ink has been discharged from the ink tanks 100*a* and 100*b*, by using the control unit (not shown), etc.

In the printer 1, when only the error signal generated by the sensor which detects the occurrence of paper jam is obtained, it is determined that the paper jam has occurred before the print operation, and the electric control unit 34 controls the light-emitting operation of the warning lamp included in the lamp group 91. When the error signal is obtained from the sensor which detects the occurrence of the paper jam and it is determined that the printing signal has been generated, it is determined that the paper jam has occurred during or after the print operation, and the electric control unit 34 controls the light-emitting operation of the warning lamp included in the lamp group 91 in a manner different from the above-described case in which the paper jam has occurred before the print operation.

Accordingly, in the printer 1, the position where the paper jam has occurred may be determined by combining the detection result obtained by at least one sensor which detects the occurrence of paper jam and the sensor which detects whether or not the printing signal has been generated. Whether the paper jam has occurred before the print operation, or during or after the print operation can be indicated by controlling the light-emitting operation of the warning lamp in accordance with the situation.

The printer 1 can inform the user whether the paper jam has occurred before the print operation, or during or after the print operation by using the above-described first to third methods. Accordingly, the user would know if the paper jam has occurred during or after the print operation, so that the risk that the wet ink on the paper sheet will stain the user's hand, clothes, etc., when the user removes the paper sheet can be reduced.

As described above, the printer 1 may include the automatic paper output mechanism for automatically outputting the jammed paper sheet through the output hole 22 in the front panel 20. More specifically, in the printer 1, although not shown in the figure, when it is possible to output the jammed paper sheet to the outside, the control unit (not shown) activates and controls the automatic paper-output mechanism disposed in the main body 30 so as to output the paper sheet to the outside. If it is not possible to output the jammed paper sheet to the outside, the above-described warning lamp is turned on without activating the automatic paper-output mechanism.

When the process performed after the occurrence of paper jam is changed in accordance with the situation as described above, even when paper jam occurs during or after the printing operation, it is not necessary for the user to insert his or hand into the main body 30 if the jammed paper sheet can be output automatically. Accordingly, the risk that the user's hand, clothes, etc., will be stained can be further reduced. The above-described automatic paper-output operation may also be performed when, for example, the user pushes a switch (not shown) included in the switch group 90.

In addition, as described above, the printer 1 may also include an illuminating unit which illuminates the inside of the main body 30 when paper jam occurs for the convenience of the user who inserts his or her hand into the main body 30.

More specifically, the printer 1 may include as the illuminating unit a light guide for guiding external illumination light into the main body 30. For example, a mirror may be formed on a part or the entire region of the back surface of the output door 50, that is, the top surface of the open output door 50, at a predetermined angle, so that the external illumination light can be guided into the main body 30. Alternatively, instead of forming the mirror on the back surface of the output door 50, a separate light guide which guides the external illumination light into the main body 30 may also be disposed at a position close to the output hole 22.

Alternatively, the printer 1 may include as the illuminating unit at least one lamp for maintenance which includes a light-emitting device which emits light when paper jam occurs in the main body 30. For example, as shown in FIG. 18, a lamp LM is disposed along the path of the paper sheet P, and when the above-described detecting unit detects that paper jam has occurred, the electric control unit 34 turns on the lamp LM. As a substitute for this lamp LM, light emitted from a sensor disposed in the main body 30, for example, the above-described sensor $SS_{AF}$ for detecting the kind of the paper sheet to be printed may also be utilized. The printer 1 may of course include the lamp LM in addition to the light emitted by the sensor, and the inside of the main body 30 may be illuminated by both the lamp LM and the light emitted by the sensor.

Accordingly, in the printer 1, by illuminating the inside of the main body 30, the user can easily view the inside of the main body 30 when he or she removes the jammed paper sheet. Therefore, the user can easily remove the paper sheet, and the risk that the user's hand, clothes, etc., will be stained can be further reduced. In addition, the printer 1 may also include both the light guide and the light-emitting device.

Next, the output-door opening mechanism 130 for opening the output door 50 will be described below.

Figure 20:
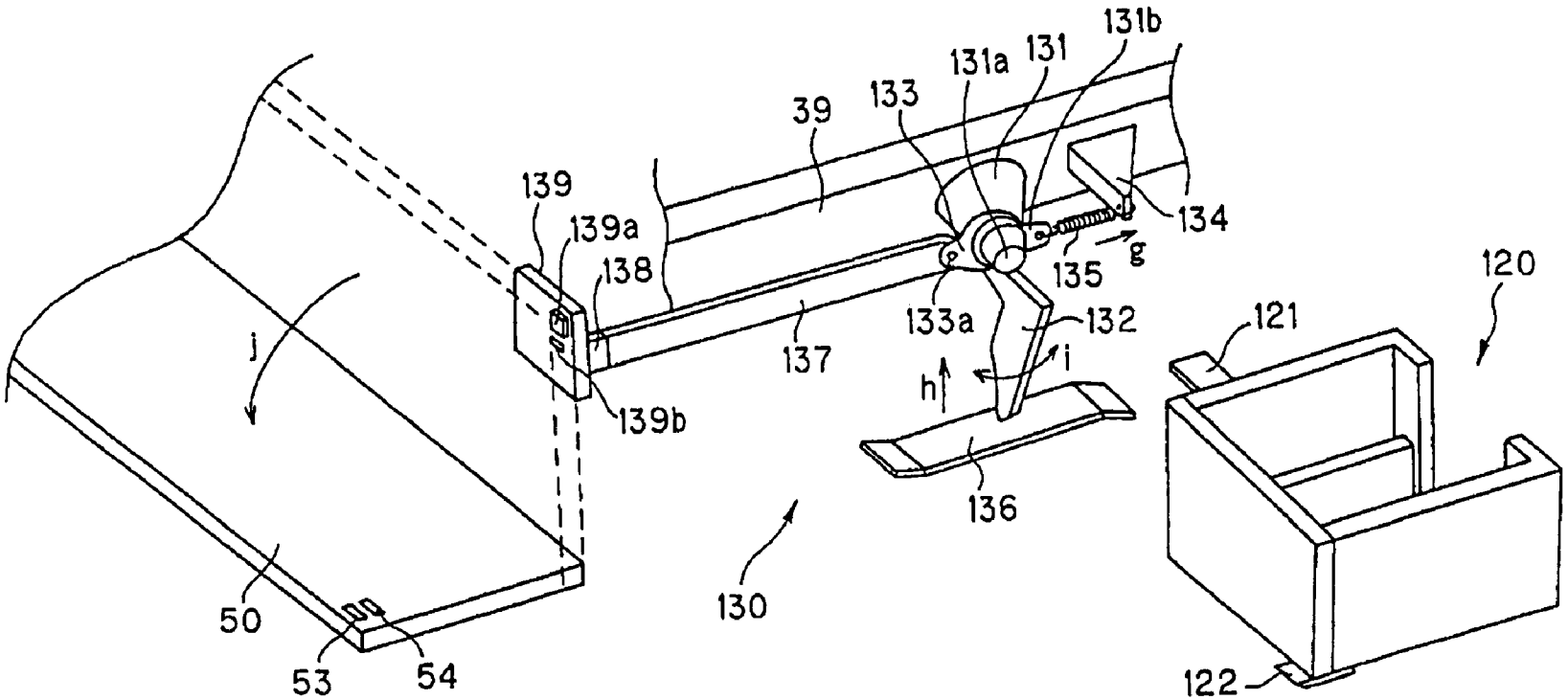
FIG. 20 is a perspective view showing the construction of an output-door opening mechanism disposed in the main body of the printer.

As shown in FIG. 20, the output-door opening mechanism 130 includes a retaining member 131 attached to a side wall 39 formed in the main body 30; a rotating lever 132 which is rotatably attached to the retaining member 131 with a pin 131*a*; a rotating member 133 which is rotatably attached to the retaining member 131 with a pin 131*a* and rotates along with the rotating lever 132; a restraining member 134 which is attached to the side wall 39 along with the retaining member 131; a coil spring 135 which is attached between the restraining member 134 and a restraining member 131*b* which is rotatably attached to the retaining member 131 with a pin 131*a* and rotates along with the rotating lever 132, the coil spring 135 applying a force to the restraining member 131*b* in the direction shown by the arrow g in the figure; a leaf spring 136 which is in contact with an end portion of the rotating lever 132 that is free-from the retaining member 131, the leaf spring 136 applying a force to the rotating lever 132 in the direction shown by the arrow h in the figure; a connecting arm 137 which is attached to the rotating member 133 with a pin 133*a* and converts the rotating movement of the rotating member 133 into linear movement; a latch 138 which is connected to the connecting arm 137 and which engages/disengages a button 54 provided on the output door 50 and a cutout 139*b* formed in a retaining plate 139, which will be described below, and the retaining plate 139 which retains the output door 50 when it is closed.

In the output-door opening mechanism 130, the rotating lever 132 is not attached to the retaining member 131 vertically, but is attached in such a manner that the rotating lever 132 is inclined by a predetermined angle. In the present embodiment, the rotating lever 132 is inclined relative to the vertical direction by a predetermined angle such that the lower end thereof is shifted toward the front panel 20. At this position, the rotating lever 132 is in the equilibrium state by receiving the force applied by the coil spring 135 in the direction shown by the arrow g in the figure and the force applied by the leaf spring 136 in the direction shown by the arrow h in the figure. In the output-door opening mechanism 130, when the rotating lever 132 attached to the retaining member 131 is rotated around the pin 131*a* in the direction shown by the arrow i in the figure, the connecting arm 137 is pulled in the direction shown by the arrow g in the figure, thereby generating a drive force for the latch 138 to disengage the button 54 and the cutout 139*b*. More specifically, in the output-door opening mechanism 130, when the rotating lever 132 is rotated leftward in the figure, the rotating member 133 also rotates leftward, and the connecting arm 137 is pulled accordingly, so that the drive force is applied to the latch 138. In addition, when the rotating lever 132 is rotated rightward in the figure, the rotating member 133 also rotates rightward, and the connecting arm 137 is pulled accordingly, so that the drive force is applied to the latch 138. In the output-door opening mechanism 130, the drive force applied to the latch 138 is adjusted by adjusting the distance by which the connecting arm 137 is pulled in accordance with the rotation of the rotating lever 132, and the engagement/disengagement of the button 54 and the cutout 139*b* is thereby switched.

Figure 21A:
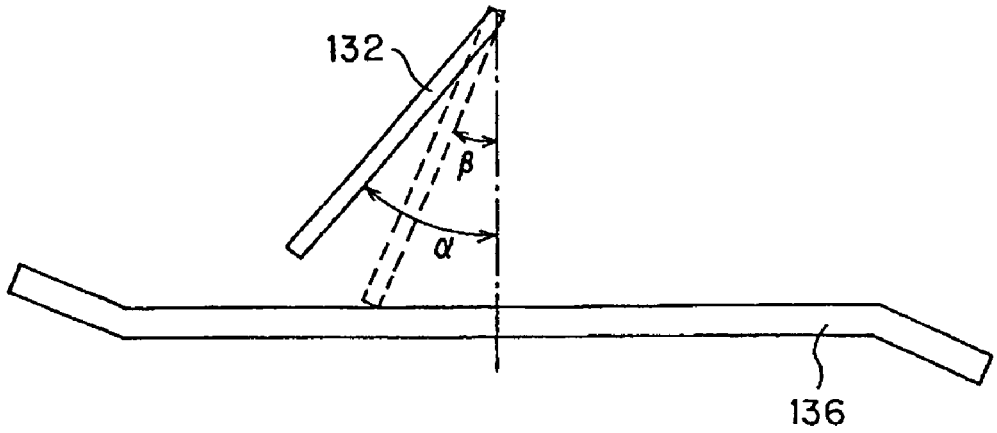
FIGS. 21A and 21B are sectional views showing the operation of the output-door opening mechanism, where
Figure 21B:
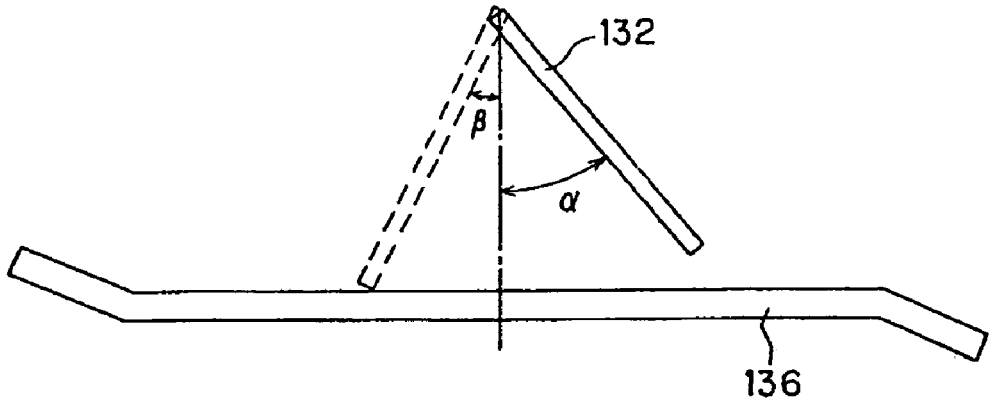

When the output door 50 comes into contact with the retaining plate 139 and covers the output hole 22 as shown by the dashed lines in FIG. 20, a metal member 53 provided on the back surface of the output door 50 at a position behind the button 51 is attached to a magnet 139*a* provided on the retaining plate 139 by a magnetic attractive force and the button 54 which is provided adjacent to the metal member 53 on the back surface of the output door 50 at a position behind the button 51 is fitted into the cutout 139*b* formed in the retaining plate 139. In this state, as shown in FIG. 21A, when the rotating lever 132 is rotated leftward in the figure to the position corresponding to an angle $\alpha$ from the vertical position shown by the dotted chain line in the figure, since the rotating lever 132 is attached to the retaining member 131 in such a manner that it is inclined by an angle $\beta$, the angle by which the rotating lever 132 actually rotates is $\alpha-\beta$. Thus, in this case, the distance by which the connecting arm 137 is pulled is small, and the drive force applied to the latch 138 is not large enough to disengage the button 54 and the cutout 139*b*. On the other hand, as shown in FIG. 21B, when the rotating lever 132 is rotated rightward in the figure to the position corresponding to an angle $\alpha$ from the vertical position, the angle by which the rotating lever 132 actually rotates is $\alpha+\beta$. Thus, in this case, the distance by which the connecting arm 137 is pulled is large, and the drive force applied to the latch 138 is enough to disengage the button 54 and the cutout 139*b*. Accordingly, the output door 50 opens by its own weight in the direction shown by the arrow j in FIG. 20.

As described above, the rotating lever 132 must be rotated to generate the drive force to open the output door 50. In the printer 1, the reciprocating movement of the ink-exchange box 120 caused by the ink-tank driving mechanism 32 is used as the drive source for rotating the rotating lever 132. More specifically, as shown in FIG. 20, a contacting tab 121 projects from the side wall of the ink-exchange box 120, and the rotating lever 132 is rotated when the contacting tab 121 moves above the leaf spring 136 and pushes the rotating lever 132.

Figure 22A:
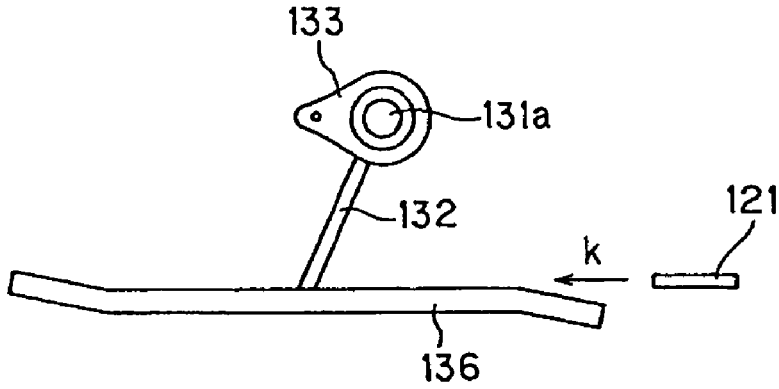
FIGS. 22A to 22D are sectional views showing the operation of the output-door opening mechanism, where
Figure 22B:
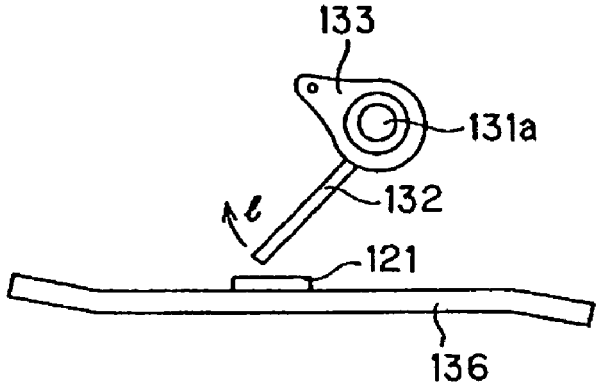

In order to describe this more specifically, with respect to FIG. 22A, a case is considered in which the contacting tab 121 is moved from the right side in the direction shown by the arrow k in the figure toward the rotating lever 132, which is in the equilibrium state by receiving the rightward force from the coil spring 135 and the force in the thickness direction of the leaf spring 136 from the leaf spring 136. In this case, as shown in FIG. 22B, the contacting tab 121 comes into contact with the rotating lever 132 and pushes the rotating lever 132, so that the rotating lever 132 rotates in the direction shown by the arrow 1 in the figure. However, since the rotating lever 132 is attached to the retaining member 131 in such a manner that the rotating lever 132 is inclined by a predetermined angle, the distance by which the connecting arm 137 is pulled is small, and the drive force applied to the latch 138 is not enough to disengage the button 54 and the cutout 139*b*. Accordingly, in this case, the output door 50 is maintained closed and continuously covers the output hole 22. In the printer 1, when the contacting tab 121 leaves the rotating lever 132, the rotating lever 132 returns to the position of equilibrium by the restoring force of the above-described coil spring 135.

Figure 22C:
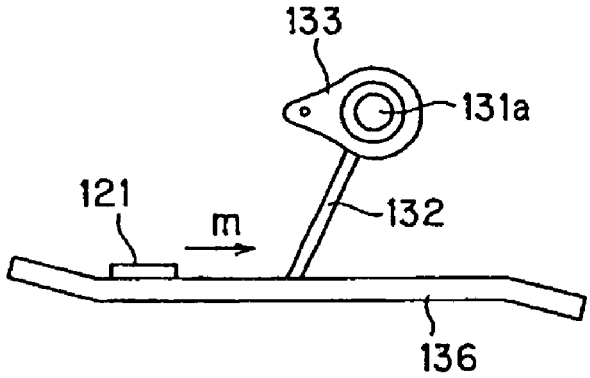
Figure 22D:
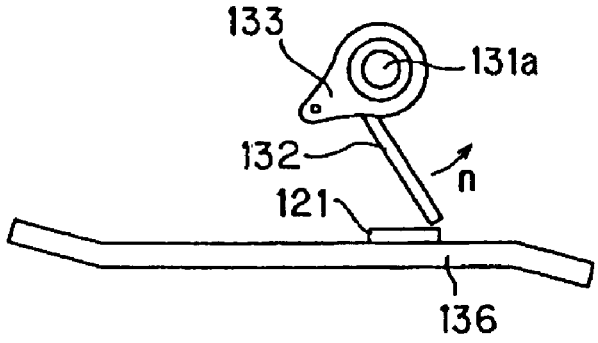

Next, with respect to FIG. 22C, a case is considered in which the contacting tab 121 is moved from the left side in the direction shown by the arrow m in the figure toward the rotating lever 132 in the equilibrium state. In this case, as shown in FIG. 22D, the contacting tab 121 comes into contact with the rotating lever 132 and pushes the rotating lever 132, so that the rotating lever 132 rotates in the direction shown by the arrow n in the figure. Since the distance by which the connecting arm 137 is pulled is large in this case as described above, the button 54 and the cutout 139*b* are disengaged by the drive force applied to the latch 138. Accordingly, in this case, the output door 50 opens by its weight and the state in which the printed paper can be output is established. In the printer 1, the leaf spring 136 is bent downward when the rotating lever 132 rotates. However, when the contacting tab 121 leaves the rotating lever 132, the rotating lever 132 returns to the position of equilibrium by the restoring force of the above-described coil spring 135 and that of the leaf spring 136.

As described above, in the printer 1, when the printing operation starts, the output-door opening mechanism 130 is activated and the output door 50 is opened by reciprocating the ink-exchange box 120 by the ink-tank driving mechanism 32. By applying the above-described mechanism, in the printer 1, the output door 50 always opens when the printing operation starts, so that it is not necessary for the user to check whether or not the output door 50 is open before starting the printing operation. In addition, in the printer 1, although the ink-exchange box 120 can be continuously reciprocated during the printing operation, it is enough if the ink-exchange box 120 is reciprocated once before the printed paper sheet is output.

Next, the lock mechanism for locking the ink-tank exchange door 60 will be described below .

Figure 23:
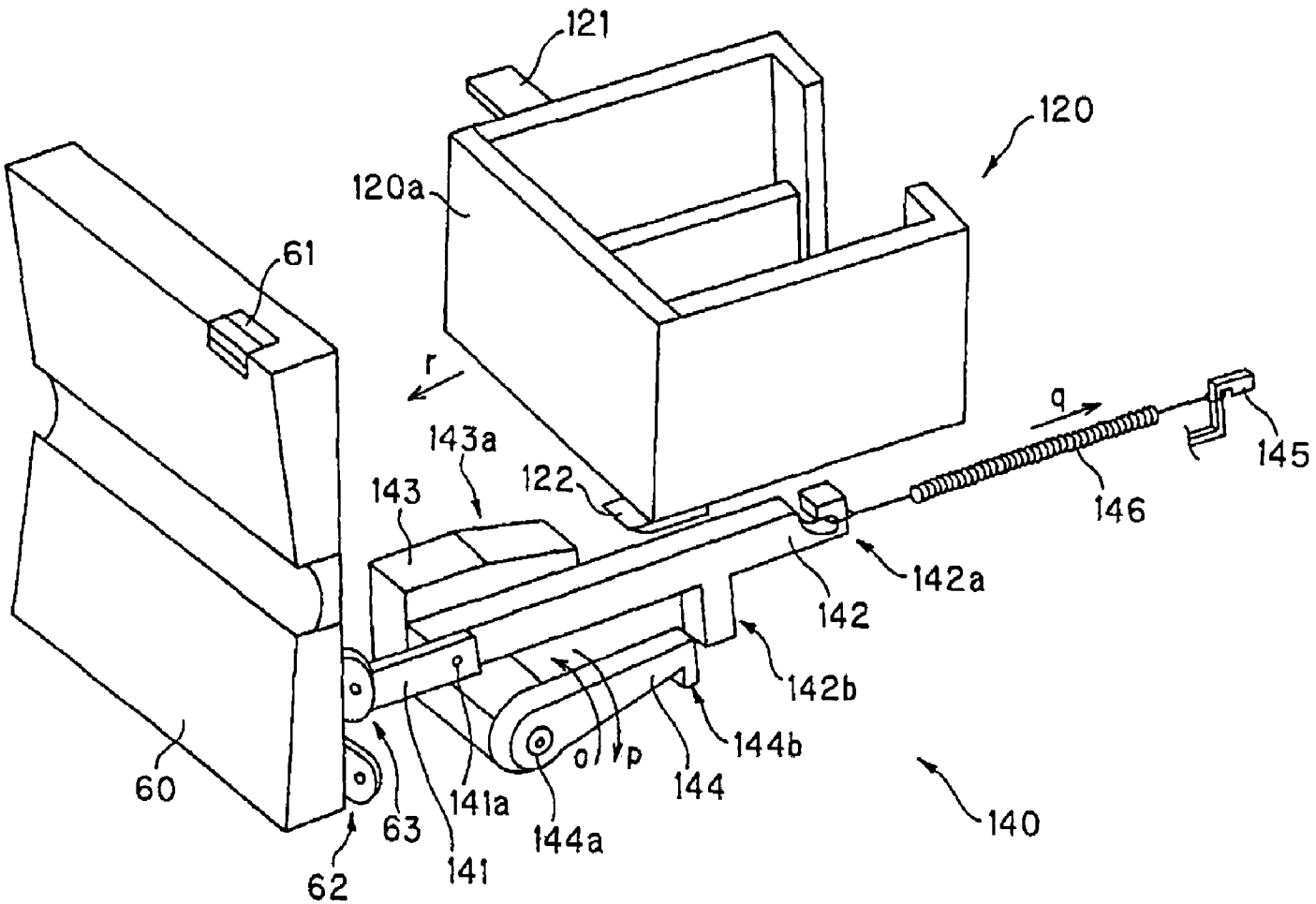
FIG. 23 is a perspective view showing the construction of a lock mechanism disposed in the main body of the printer.

As shown in FIG. 23, the lock mechanism 140 is provided along the ink-tank driving mechanism 32 (not shown) and is connected to the ink-tank exchange door 60. In addition, the lock mechanism 140 includes a linking arm 141 which is rotatably attached to a retaining member 63 of the ink-tank exchange door 60 with a pin (not shown) at one end of the linking arm 141; an operating arm 142 which is rotatably attached to the other end of the linking arm 141 with a pin 141*a* at one end of the operating arm 142; an activating plate 143 which is rotatably attached to the operating arm 142 with the pin 141*a*; an activating member 144 which is rotatably attached to the activating plate 143 with a rotating shaft 144*a* and which rotates along with the activating plate 143 in the directions shown by the arrows o and p in the figure; a restraining tab 145 which is disposed on the extension of the operating arm 142 at the side closer to an end of the operating arm 142 that is free from the linking arm 141; and a coil spring 146 which is disposed between a restraining tab 142*a* which is formed at the end of the operating arm 142 that is free from the linking arm 141 and the restraining tab 145, the coil spring 146 applying a force to the operating arm 142 in the direction shown by the arrow q in the figure.

In the lock mechanism 140, the operating arm 142 and the linking arm 141 are pulled in the direction shown by the arrow q in the figure by the force applied by the coil spring 146, so that the ink-tank exchange door 60 is prevented from being opened. In addition, in the lock mechanism 140, a locking claw portion 144*b* is formed at the end of the activating member 144 by bending the end portion of the activating member 144 approximately vertically. In addition, the operating arm 142 is formed in a T shape such that an engaging claw portion 142*b* which engages with the locking claw portion 144*b* projects at a certain position of the operating arm 142 in the longitudinal direction. Furthermore, although not shown in the figure, a torsion spring, etc., is attached to the rotating shaft 144*a* for applying a force to the activating member 144 in the direction shown by the arrow o in the figure, so that the locking claw portion 144*b* engages with the claw portion 142*b*.

Accordingly, the lock mechanism 140 locks the ink-tank exchange door 60 while it is closed so as to cover the ink-exchange hole 23 by engaging the locking claw portion 144*b* and the engaging claw portion 142*b*.

When one or both of the ink tank 100*a* and 100*b* are to be engaged, the lock mechanism 140 must release the lock so that the ink-tank exchange door 60 can be opened. Accordingly, in the printer 1, the lock is released by using a contacting tab 122 which projects from the bottom of the ink-exchange box 120 toward the ink-tank exchange door 60. More specifically, in the printer 1, the top surface of the activating plate 143 of the lock mechanism 140 is formed as a slope 143*a*, and when the ink-exchange box 120 is moved in the direction shown by the arrow r in the figure by the ink-tank driving mechanism 32, the bottom surface of the contacting tab 122 slides on the slope 143*a* so as to release the lock.

More specifically, in the lock mechanism 140, when the ink-exchange box 120 moves along the slope 143*a* while the bottom surface of the contacting tab 122 slides on the slope 143*a*, the activating plate 143 rotates around the pin 141*a* in the direction shown by the arrow p in the figure. Accordingly, in the lock mechanism 140, the activating member 144 also rotates around the rotating shaft 144*a* in the direction shown by the arrow p in the figure, so that the locking claw portion 144*b* and the engaging claw portion 142*b* are disengaged from each other.

In the printer 1, when the lock is released in the above-described manner, the side plate 120*a* of the ink-exchange box 120 comes into contact with the ink-tank exchange door 60 and pushes it, so that the ink-tank exchange door 60 opens. In addition, in the printer 1, when the ink-exchange box 120 is moved in the direction shown by the arrow q in the figure by the ink-tank driving mechanism 32, the operating arm 142 and the linking arm 141 is pulled in the direction shown by the arrow q in the figure by the restoring force of the coil spring 146, and the ink-tank exchange door 60 is closed accordingly.

At this time, in the lock mechanism 140, when the bottom surface of the contacting tab 122 comes away from the slope 143*a*, the activating member 144 receives the force in the direction shown by the arrow o in the figure again, so that the locking claw portion 144*b* and the engaging claw portion 142*b* are engaged with each other.

Accordingly, in the printer 1, the lock mechanism 140 locks the ink-tank exchange door 60 while the ink-tank exchange door 60 is closed to cover the ink-exchange hole 23, so that the ink-tank exchange door 60 is prevented from being opened manually by the user. Accordingly, in the printer 1, the ink-tank exchange door 60 is prevented from being opened unnecessarily by the user, and the possibility that dust will flow into the main body 30 through the ink-exchange hole 23 can be reduced.

Next, the optional device 80 will be described below.

The optional device 80 is used for expanding the functions of the printer 1. The optional device 80 may be, for example, an interface for transmitting/receiving data to/from an external device by wire communication using USB, IEEE 1394, etc., or by radio communication using infrared light, bluetooth, etc. Alternatively, the optional device 80 may also be a drive device for attaching/detaching a recording medium such as a memory card. The printer 1 can convert data supplied from the external device via the optional device 80 or data recorded in the recording medium into a format suitable for the printing process. In the following description, an example in which the optional device 80 is the interface which transmits/receives data by wire communication will be explained.

Figure 24:
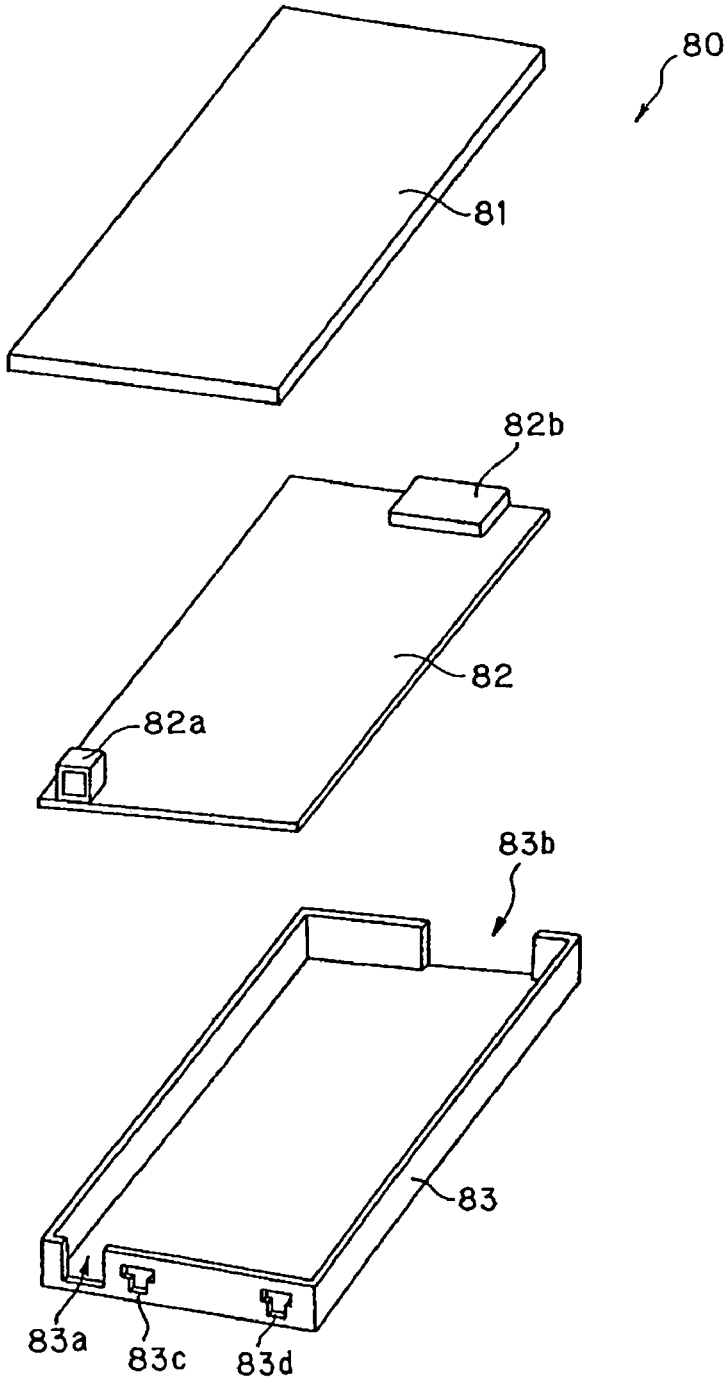
FIG. 24 is an exploded perspective view showing the construction of an optional device.

More specifically, as shown in FIG. 24, the optional device 80 includes an upper half 81 and a lower half 83 which are composed of a metal and which have shielding ability and a substrate 82.

The substrate 82 includes a bus connector 82*a* to which a bus is connected and a connector 82*b* for providing electrical connection to the main body 30. In the case in which the optional device 80 is the interface which transmits/receives data by radio communication, a light-receiving device for receiving signals is disposed on the substrate 82 instead of the bus connector 82*a*.

A notch 83*a* for exposing the bus connector 82*a* of the substrate 82 to the outside and a notch 83*b* for exposing the connector 82*b* of the substrate 82 to the outside are formed in the sidewalls of the lower half 83. In addition, openings 83*c* and 83*d* for attaching the panel 28, which will be described below, are formed in one of the sidewalls of the lower half 83.

Figure 25:
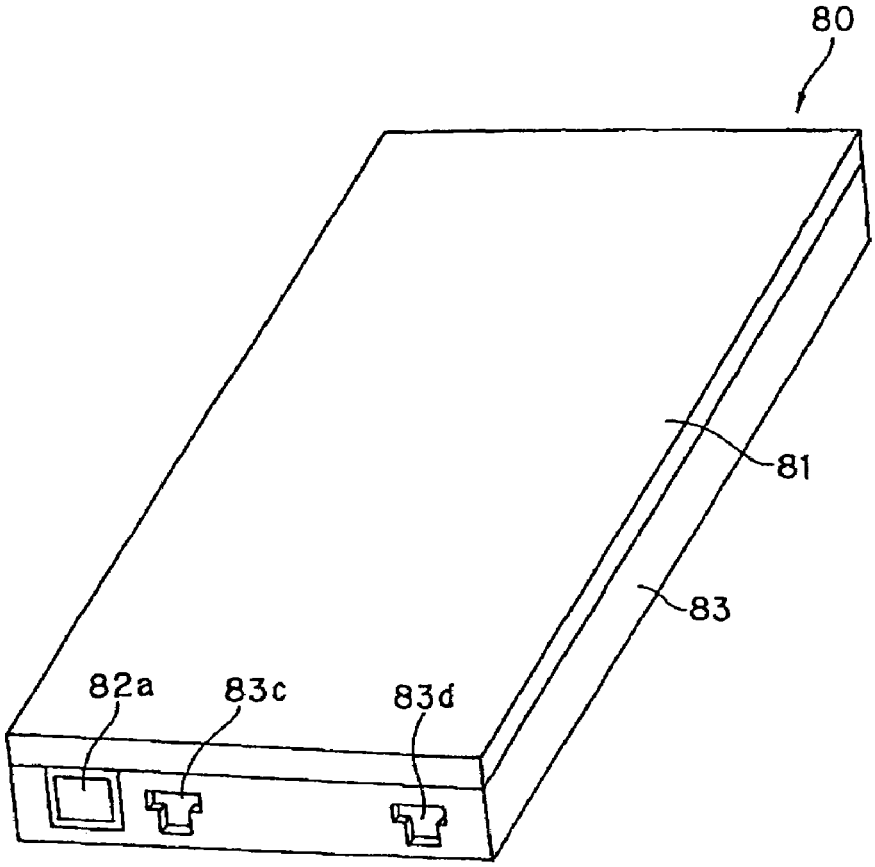
FIG. 25 shows the constructions of the optional device and a panel attached to the optional device.
Figure 25:
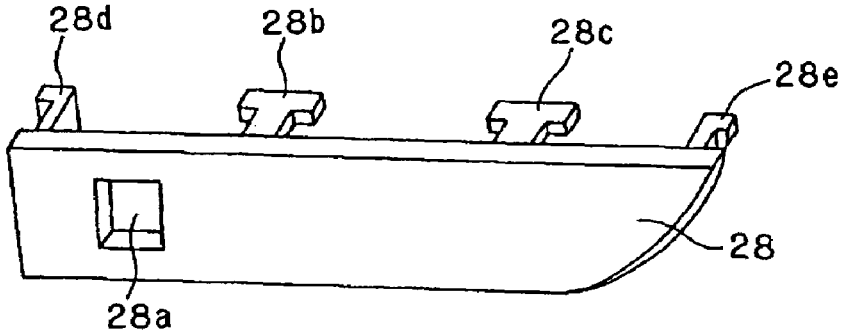

In the optional device 80, the substrate 82 is disposed in the lower half 83 and attached to the lower half 83 by screws, etc., and the upper half 81 is disposed so as to cover the lower half 83. Accordingly, as shown in FIG. 25, the substrate 82 is disposed between the upper half 81 and the lower half 83, which form an approximately rectangular parallelepiped housing. Thus, the optional device 80 is resistant to static electricity, noise, etc., and does not easily break.

Figure 26:
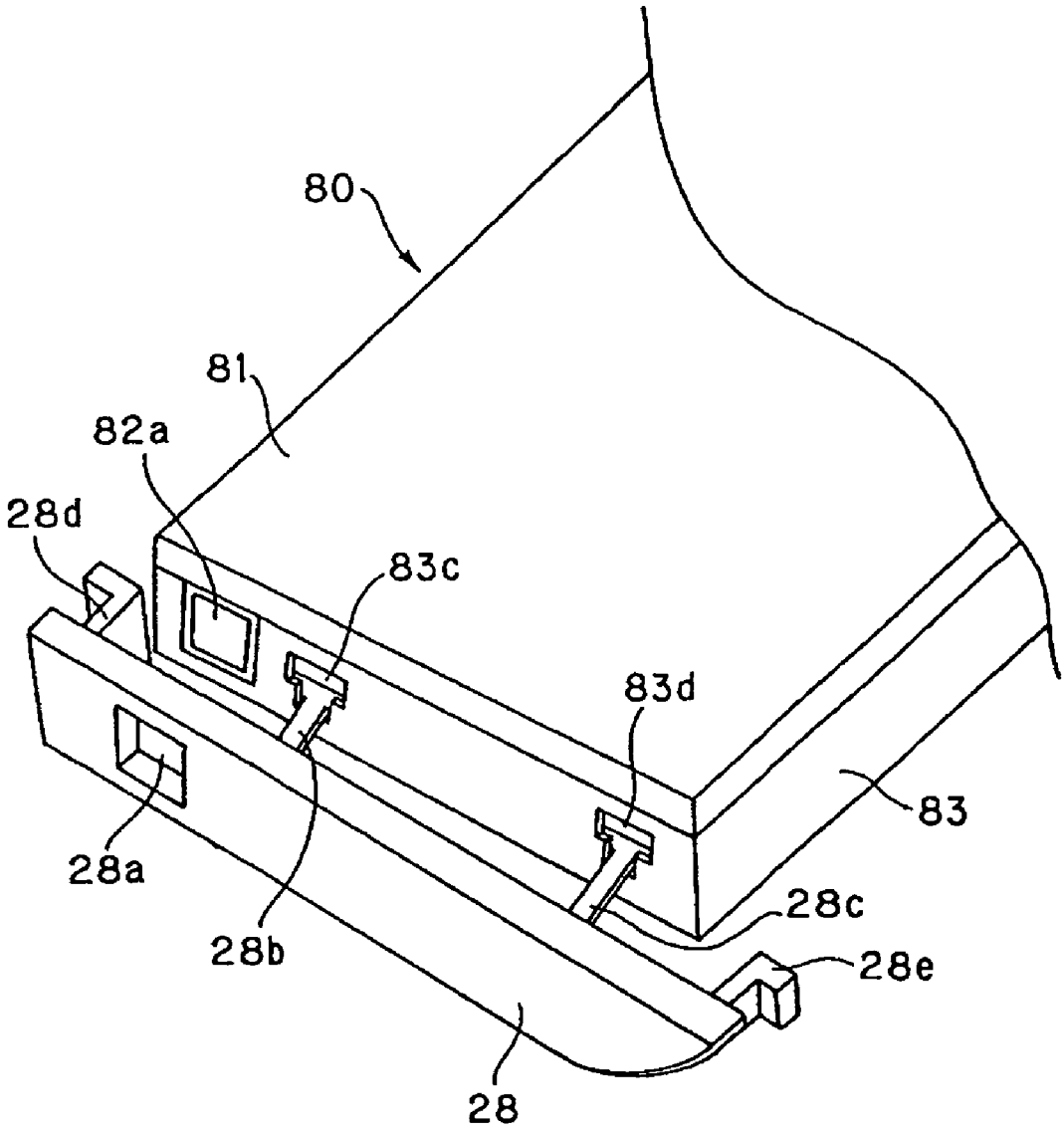
FIG. 26 is a perspective view of the optional device and the panel, showing the manner in which the panel is attached to the optional device.

In addition, the panel 28 shown in FIG. 25 is attached to the optional device 80. As described above, the main surface of the panel 28 has approximately the same shape as that of the optional-device attachment hole 24 in the front panel 20. In addition, the main surface of the panel 28 has an opening 28*a* for exposing the bus connector 82*a*, which faces outward via the notch 83*a*, to the outside when the optional device 80 is attached to the main body 30. In addition, the panel 28 also has flexible attaching members 28*b* and 28*c* on the back surface thereof. As shown in FIG. 26, the panel 28 is attached to the optional device 80 by inserting the attaching members 28*b* and 28*c* into the openings 83*c* and 83*d*, respectively. Each of the attaching members 28*b* and 28*c* has a T-shape in cross section whose width increases at the end portion thereof, and the end portions of the attaching members 28*b* and 28*c* serve as stoppers when the attaching members 28*b* and 28*c* are inserted into the openings 83*c* and 83*d*, respectively, so that the attaching members 28*b* and 28*c* can be prevented from being easily released from the openings 83*c* and 83*d* of the optional device 80. In addition, the panel 28 includes claw portions 28*d* and 28*e* having an L-shape in cross section at both ends of the back surface of the panel 28, and the claw portions 28*d* and 28*e* are snapped into the optional-device attachment hole 24 in the panel 28.

As shown in FIG. 26, the panel 28 is attached to the optional device 80 with a certain freedom by providing clearances between the flexible attaching members 28*b* and 28*c* and the openings 83*c* and 83*d* of the optional device 80. The optional device 80 to which the panel 28 is attached is detachably attached to the main body 30 through the optional-device attachment hole 24 in the front panel 20. When the optional device 80 is attached to the main body 30, the panel 28 is fitted into the optional-device attachment hole 24 after the optional device 80 is attached to the main body 30, and serves as an external panel in combination with the front panel 20. In addition, when the optional device 80 is detached from the main body 30, the panel 28 is released from the optional-device attachment hole 24 first, and is used as a handle for pulling out the optional device 80 from the main body 30.

Figure 27:
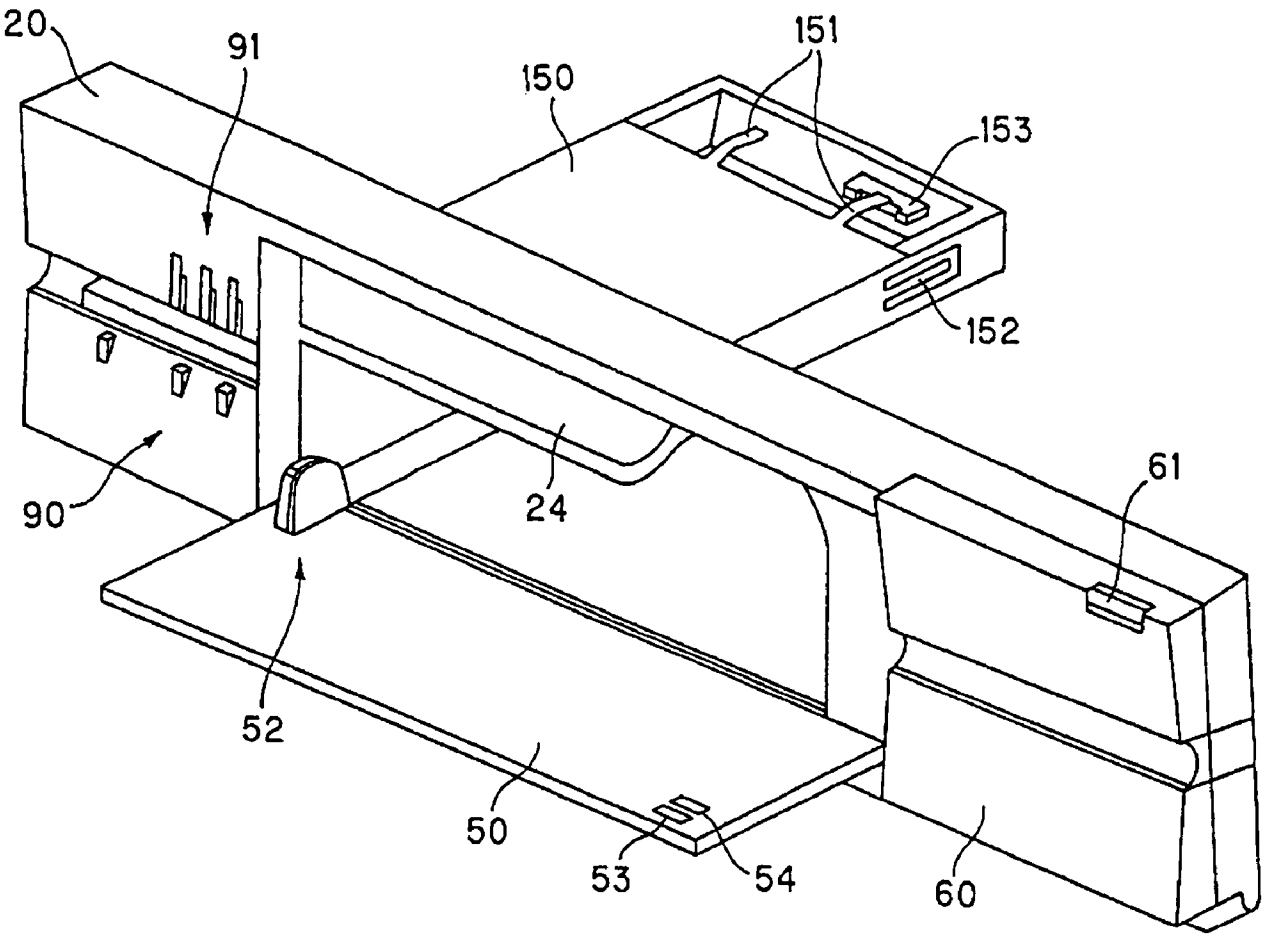
FIG. 27 is a perspective view of the main part of the printer showing the construction of a slot to which the optional device is attached.

The optional device 80 is detachably attached to a slot 150 shown in FIG. 27 through the optional-device attachment hole 24 in the front panel 20. The slot 150 is attached to the main body 30 in such a manner that the slot 150 is continuous to the optional-device attachment hole 24, and stores the optional device 80 while pressing it with spring members 151 and 152 formed in the top and side surfaces of the slot 150. Since the optional device 80 is pressed by the spring members 151 and 152 in the slot 150, the upper. half 81 and the lower half 83 of the optional device 80 can be closely attached to each other, and the optional device 80 can be placed reliably. In addition, the slot 150 has a connector 153 on the bottom wall thereof toward which the optional device 80 is inserted, and the optional device 80 is electrically connected to the main body 30 by inserting the connector 82*b* of the optional device 80 into the connector 153.

Accordingly, in the printer 1, since the panel 28 is attached to the optional device 80, the operability is considerably improved and a high-quality appearance is provided. In addition, since the optional device 80 and the panel 28 are connected to each other by a simple structure, each component can be prevented from being lost. Accordingly, costs can be reduced. In addition, when the optional device 80 is not attached to the main body 30, only the panel 28 is attached to the optional-device attachment hole 24 and serves as an external plate in combination with the front panel 20. Accordingly, in the printer 1, the possibility that dust will flow into the main body through the optional-device attachment hole 24 can be reduced and a high-quality appearance can be provided.

As described above, since the panel 28 is attached to the optional device 80 with a certain degree of freedom, it can move relative to the optional device 80. This structure is used so that the optional device. 80 can be easily and reliably attached to the slot 150. More specifically, from the viewpoint of mass production of the optional device 80 and the slot 150, the optional device 80 and the slot 150 normally include individual differences caused in the production process. In other words, the optional device 80 and the slot 150 have dimensional tolerances. If the panel 28 is combined with the optional device 80 such that the panel 28 cannot move relative to the optional device 80, the positional relationship between the panel 28 and the optional-device attachment hole 24 is uniquely determined. Accordingly, there is a risk in that the connector 82*b* of the optional device 80 will be displaced from the connector 153 of the slot 150 so that the optional device 80 cannot be attached to the slot 150. Therefore, in the printer 1, the panel 28 is attached to the optional device 80 with a certain freedom so that connector 82*b* can be reliably inserted into the connector 153 and the panel 28 can be moved to a position corresponding to the optional-device attachment hole 24 so as to cancel the displacement between the connector 82*b* and the connector 153.

Figure 28:
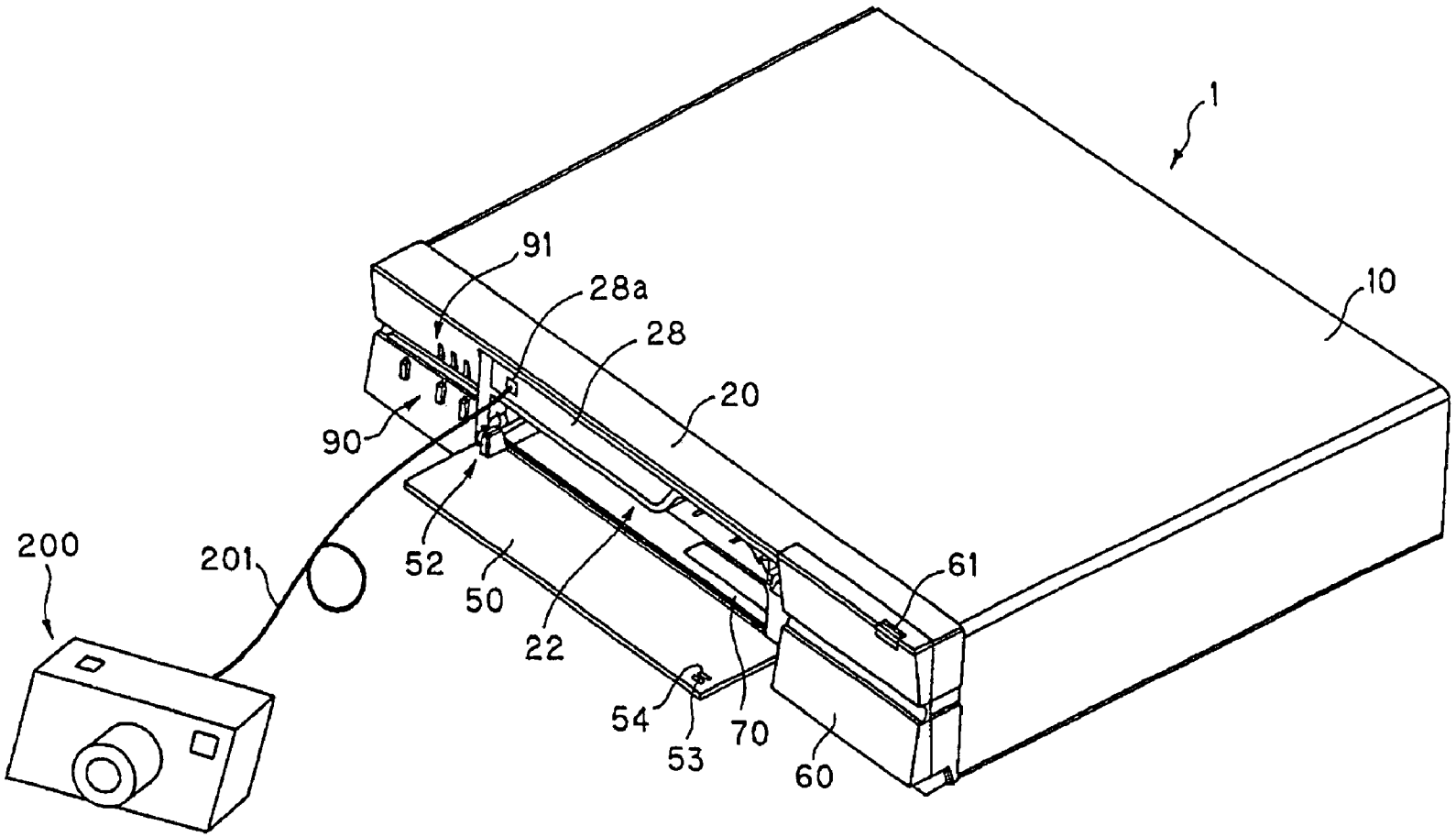
FIG. 28 is a diagram showing an example of a manner in which the optional device is used.

When the optional device 80 with the panel 28 is attached to the main body 30, the printer 1 can receive image data from the external device and print the image corresponding to this image data. More specifically, as shown in FIG. 28, after the optional device 80 is attached to the main body 30, the bus connector 82*a* which faces outward through the opening 28*a* in the panel 28 can be connected to, for example, a digital still camera 200 by a cable 201. In such a case, the printer 1 can directly receive the data of images photographed and recorded by the digital still camera 200 and print the images without using a host computer, etc.

Accordingly, the printer 1 can receive the image data not only via the bus connector 38 provided on the main body 30 as described above, but also from the optional device 80 attached to the main body 30. Therefore, in the printer 1, it is not necessary to connect a wire to the back of the main body 30 where the bus connector 38 is disposed each time the external device is to be connected; instead, the external device can be connected to the printer 1 at the front of the printer 1. Therefore, the user can connect the external device with great convenience without performing complex work. Further more, the printer 1 can of course provide greater convenience by continuously connecting a stationary external device, such as a computer, to the bus connector 38.

As described above, in the printer 1 according to the embodiment of the present invention, since the operation surfaces for all of the main operations are provided on the front panel 20, all of the main operations can be performed through the front panel 20. Thus, the printer 1 exhibits excellent operability. In addition, since an object can be placed on the top surface of the printer, the printer 1 can be stacked together with other AV devices, so that the installation space can be reduced. In addition, it is not necessary for the user to perform complex work, so that great convenience is provided. Furthermore, in the printer 1, the possibility that dust will enter the main body 30 can be greatly reduced and paper sheets can be stored without degrading them, so that high reliability is ensured. Accordingly, a high-reliability printer which can be easily operated and which provides great convenience to the user is provided.

The present invention is not limited to the above-described embodiment. For example, in the above-described embodiment, the output-door opening mechanism 130 for opening the output door 50 is activated by the movement of the ink-exchange box 120 caused by the ink-tank driving mechanism 32. However, the present invention is not limited to this, and the output door 50 may also be opened by using another mechanism which does not use the movement of the ink-exchange box 120.

In addition, in the above-described embodiment, the contacting tab 122 of the ink-exchange box 120 is used for releasing the lock of the ink-tank exchange door 60. However, the lock may also be released without using the contacting tab 122.

Figure 29:
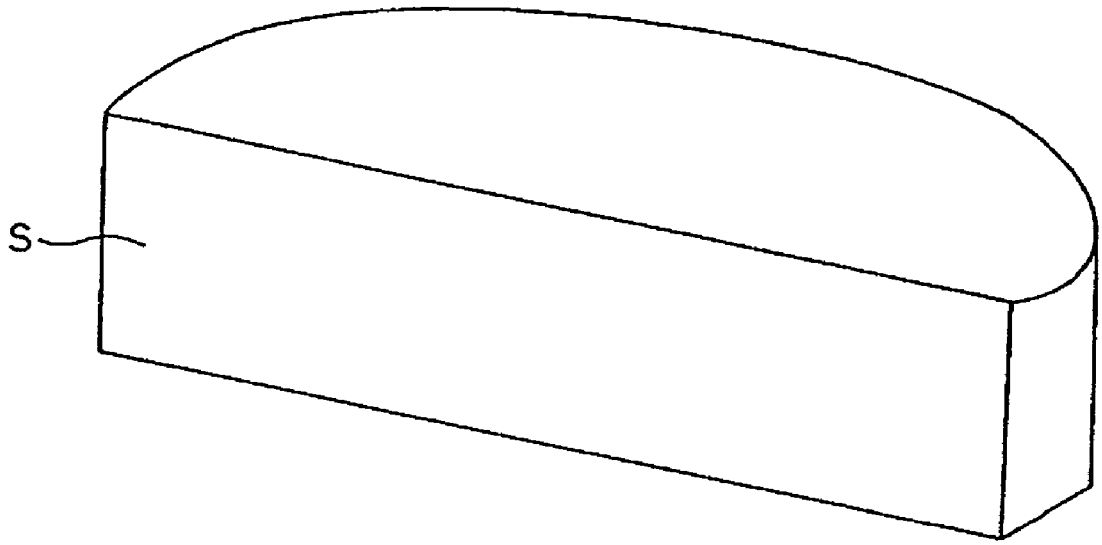
FIG. 29 is a perspective view showing a modification of the external shape of the printer.

In addition, in the above-described embodiment, the external housing of the printer 1 has an approximately rectangular parallelepiped shape. However, as shown in FIG. 29, the external housing of the printer according to the present invention may have a shape such that a column is cut in the vertical direction along a line passing through two predetermined points on the circumference of the column. In the printer having such a shape, when the plane S along which the column is cut has the functions similar to those of the above-described front panel, the user can perform all of the main operations at the front.

Accordingly, the shape of the external housing of the printer is not limited as long as the surface facing the user is approximately flat and serves as the operation surface.

In addition, although the printer 1 has a serial head and performs the print operation by the inkjet method, the present invention may also be applied to a printer having a line head in which a plurality of driving devices are arranged along the direction vertical to the paper-conveying direction instead of the serial head. Furthermore, the present invention may be applied not only to a printer which performs the print operation by the inkjet method but also to a printer which performs the print operation by the thermal transfer method. In the case in which the present invention is applied to the printer which performs the print operation by the thermal transfer method, components for exchanging ink ribbons are substituted for the components for exchanging the ink tanks.

As described above, various modifications are of course possible within the scope of the present invention.

What is claimed is:

1. An image forming apparatus which forms an image on a paper sheet, comprising:

an external panel having an approximately flat main surface which serves as a surface of the external housing of the image forming apparatus, a feed-tray attachment hole for attaching a feed tray which stores the paper sheets prior to printing, and an output hole for outputting the paper sheet after the image is printed; and an output door covering the output hole such that the output door can be opened and closed, the output door being opened when the printed paper sheet is output through the output hole;

wherein the output door supports the printed paper sheet and/or an output tray while the output door is open and the printed paper sheet is output through the output hole;

wherein all paper types are aligned to a side of the output hole that is larger than the other, and further wherein the feed tray and output tray are parallel to each other.

2. The image forming apparatus according to claim 1, wherein the image is formed on the paper sheet with dots formed by discharging drops of ink toward the paper sheet.

3. The image forming apparatus according to claim 1, wherein the external panel has an ink-exchange hole for exchanging an ink tank containing ink.

4. The image forming apparatus according to claim 3, wherein the image forming apparatus further comprises an ink-exchange door which is attached to the external panel to cover the ink-exchange hole.

5. The image forming apparatus according to claim 1, wherein the output door supports the output tray while the output door is open and the printed paper sheet is output through the output hole; and wherein an edge portion of the output tray that is close to the output door overlaps an edge portion of the open output door and the top surface of the output tray is positioned higher than the top surface of the open output door.

6. The image forming apparatus according to claim 1, wherein the output door supports the output tray while the output door is open and the printed paper sheet is output through the output hole; and wherein the paper output tray is detachably attached to a main body portion of the image forming apparatus through the output hole.

7. The image forming apparatus according to claim 1, wherein the external panel has an operation-component hole for exposing one or more operation components for performing various operations and a light-emitting-device hole for exposing one or more light-emitting devices for indicating various states of the image forming apparatus.

8. The image forming apparatus according to claim 1, further comprising a removable cover on A rear panel of the apparatus, wherein a jammed paper sheet is removed either through said output hole or said rear panel.

9. The image forming apparatus according to claim 1, further comprising illuminating means which illuminates an internal portion of the image forming apparatus.

10. The image forming apparatus according to claim 9, wherein the illuminating means comprises a light guide which guides external illumination light into the main body of the image forming apparatus.

11. The image forming apparatus according to claim 10, wherein the light guide comprises a mirror disposed over at least a part of a top surface of the open output door at a predetermined angle.

12. The image forming apparatus according to claim 9, wherein the illuminating means comprises at least one light-emitting device which emits light when the paper sheet is jammed in a main body of the image forming apparatus.

13. The image forming apparatus according to claim 12, wherein the at least one light-emitting device is placed along a conveying path of the paper sheet.

14. An image forming apparatus which forms an image on a paper sheet, comprising:

an external panel having an approximately flat main surface which serves as a surface of the external housing of the image forming apparatus, a feed-tray attachment hole for attaching a feed tray which stores paper sheets prior to printing, and an output hole for outputting the paper sheet after the image is printed; and an output door covering the output hole such that the output door can be opened and closed, the output door being opened when the printed paper sheet is output through the output hole;

wherein opening of the output door is caused by the reciprocating movement of an ink-tank during the image forming process, and further wherein the feed tray and output door are parallel to each other.

* * * * *